US009751221B1

(12) United States Patent
Aylsworth

(10) Patent No.: US 9,751,221 B1
(45) Date of Patent: Sep. 5, 2017

(54) LEVER LINK MECHANISM FOR A FOLDING KNIFE

(71) Applicant: Matthew G. Aylsworth, Scottsdale, AZ (US)

(72) Inventor: Matthew G. Aylsworth, Scottsdale, AZ (US)

( * ) Notice: Subject to any disclaimer, the term of this patent is extended or adjusted under 35 U.S.C. 154(b) by 233 days.

(21) Appl. No.: 14/486,767

(22) Filed: Sep. 15, 2014

(51) Int. Cl.
*B26B 1/04* (2006.01)

(52) U.S. Cl.
CPC ..... *B26B 1/04* (2013.01); *B26B 1/048* (2013.01)

(58) Field of Classification Search
CPC .... B26B 1/00; B26B 1/02; B26B 1/04; B26B 1/042; B26B 1/044; B26B 1/046; B26B 1/048
USPC ..... 30/153, 155–161; D8/99, 100
See application file for complete search history.

(56) References Cited

U.S. PATENT DOCUMENTS 4,974,323 A * 12/1990 Cassady ..... B26B 1/048 30/155
5,495,674 A 3/1996 Taylor, Jr.
6,079,106 A * 6/2000 Vallotton ..... B26B 1/048 30/155
6,145,202 A 11/2000 Onion
6,158,127 A 12/2000 Taylor
6,289,592 B1 * 9/2001 Emerson ..... B26B 1/046 30/155
6,360,443 B1 3/2002 Remus
7,062,857 B1 6/2006 Nenadic
7,181,849 B2 2/2007 Menter
7,513,045 B2 4/2009 Kain
7,634,858 B1 * 12/2009 Frazer ..... B26B 29/02 30/151
7,694,421 B2 4/2010 Lin
7,979,990 B2 7/2011 Hawk
2002/0029481 A1 * 3/2002 Eickhorn ..... B26B 1/042 30/161
2006/0080841 A1 * 4/2006 Hatcher ..... B26B 1/046 30/155
2006/0200995 A1 * 9/2006 Anderson ..... B26B 1/048 30/153
2007/0124940 A1 * 6/2007 Hawk ..... B26B 1/04 30/161
2010/0242288 A1 * 9/2010 Onion ..... B26B 1/02 30/160
2011/0067246 A1 3/2011 Perez
2013/0291389 A1 11/2013 Chen

* cited by examiner

*Primary Examiner* — Stephen Choi
*Assistant Examiner* — Evan MacFarlane
(74) *Attorney, Agent, or Firm* — Sarah J. Rhoades

(57) ABSTRACT

An ambidexterous, springless folding knife mechanism allows a user to open and close the knife with the repetition of a single motion by either hand. This knife does not require any spring to open or retract the blade back into the handle. A lever link couples the knife handle and the knife blade in a hinged manner. Slight modifications of the mechanism will permit the blade to be opened to a variety of angles depending on the positioning of the mechanism during the initial design. Such modification would allows application of the mechanism to other folding hand tools. In the preferred embodiment, the open and closed position of the blade does not require the blade to travel a full 180 degrees but locks the blade in a substantially straight position for use. The mechanism allows knife operation by those with handicaps or dexterity issues.

9 Claims, 24 Drawing Sheets

LEVER LINK MECHANISM FOR A FOLDING KNIFE

CROSS-REFERENCE TO RELATED APPLICATIONS

None.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention relates to folding hand tools in which a blade or working member pivots to be enclosed in protective sheath which forms a handle when the tool is in use, and relates especially to folding knives, and specifically to an improved device for moving and locking the blade with a single hand.

2. Description of the Related Art

Folding knives have been around for millennia. Modern pocket knives have used springs and locks to hold blades in an extended, open position for use or in a folded, closed position within a handle for storage. Springs have become the primary mechanism to open or retract the blade back into the handle. However, springs have their disadvantages. Springs may apply excess, unneeded force to open or close the folding tool. Springs also wear over time and may also make the folding tool more dangerous to use.

In inventions where springs were removed, folding knives commonly require two hands and a great deal of strength and dexterity to unfold. Other inventions have sought to harness the power of the spring to also provide for easy access to a blade. These inventions which have sought to allow for single-handed implementation have commonly required spring-loaded buttons or ever more complicated mechanisms. In these knives, the buttons for opening or closing the blade are designed to be used in only one hand, usually the right hand, but they are not designed for equal use in either hand.

Even with the assistance of springs and locks, most knives still either require two hands to operate or a specific hand. Two hands or a specific hand are not always available to properly operate these knife features. Improper use of such mechanisms may make knives more hazardous to use in certain circumstances. Despite the centuries of work on perfecting the folding knife, the mechanisms available today are still too cumbersome and dangerous to be used by individuals with handicaps or otherwise limited dexterity. An improved folding knife tool is needed.

BRIEF SUMMARY OF THE INVENTION

For the present, springless folding knife mechanism a lever link assembly joins and actuates the hinged folding of a blade into and out of a handle assembly. The lever link assembly articulates the blade movement due to its interplay with at least two channels in the handle and the blade. A lock bar or pin floats, oscillates, or travels, through the channels, or guides. A linkage to a lever is used to actuate the movement of the lock bar by the knife user. The unique, multi-channel and oscillating pin combination creates a counter-rotation within the handle of the blade which is controlled by a user snapping his wrist or providing a forward thrust from his arm and elbow as he holds onto the grip of the lever, momentarily separating the lever positioned at the top of the handle which pulls the pin, or locking bar out of respective locking grooves and moves it into the curved channels and toward the opposite locking grooves in the channels. The same motion of snapping the wrist will again pull the lever and reverse the travel through the channels, toward the opposite grooves once again.

A complete knife according to the present invention comprises a blade, a lever assembly, a link assembly, at least one lever grip, at least one handle assembly, and at least one liner such that the other components attach to the liner creating a space to receive the blade as it folds into the handle and an interior working space for the movement of the lever and link mechanism within the knife. A tang section at the base of the blade is shaped to cooperate with the handle assembly and lever and link components. The tang comprises a pivot hole, a channel, at least one tang lock bar groove, at least one stop interface, and at least one lever interface. In the preferred embodiment, the tang specifically incorporates the channel and two or more lock bar stopping grooves to guide, catch and hold the blade. The blade is joined with the handle assembly by the other tang features. The lever and link assemblies provide a counter-rotation measure which moves the blade about a main pivot axis and to fold in and out of the handle assembly. The handle assembly is made up of a bolster section and a handle section which may occur in one or more pieces. The lever and link sit within the bolster of the handle assembly. The lever grip is accessed by the user near the middle to distal end of the handle assembly.

A single flicking motion of either wrist—as the user cradles the handle in his or her palm and maintains a finger and thumb hold on either side of the lever grip—will open and close the blade from a stored position to an exposed and ready to use position. This simple means of exposing or closing a knife blade makes a folding knife employing the lever and link mechanism of the present invention readily usable in either hand and by anyone with limited dexterity or a disability. Circumstances where knives are used may cause the user to be under external environmental forces which cause a limitation on his or her dexterity. Natural limitations on dexterity may also be caused by a disability or advanced age. Environmental causes may include the use of gloves or other challenges one encounters while trying to accomplish a task and hold a knife in one hand. The knife mechanism of the present invention will allow a user to overcome these limitations because it is opened or closed with the repetition of a simple motion such as the single flick of the wrist.

In its simplest form, the present invention provides an ambidextrous, springless, folding blade mechanism comprised of three fixed pivot points (the handle-to-lever pivot, the lever-to-link pivot, and the main blade-to-handle pivot) and one oscillating pivot (the lock bar or pin on the lever link). More specifically, by way of example and not by limitation, the folding blade mechanism specifically comprises a first fixed pivot joining a lever and a blade handle, a second fixed pivot joining the lever and a link, wherein the link is joined with the oscillating pivot, such that when the first and second pivot are moved, motion is initiated in the oscillating pivot which causes a third fixed pivot joining the blade and the blade handle to move the blade from a closed position to an open position.

In the preferred embodiment, the oscillating pivot incorporates a link arm in the shape of a figure-8 with one end of the lock bar or floating pin affixed to the link arm. One end of the lock bar, or pin is affixed into the corresponding hole in the link arm to stop the movement of the lock bar and prevent unwanted movement or play of the lock bar. Unwanted play could jam the mechanism, causing a malfunction in the knife. The opposite end of the lock bar, or pin is not fixed into the link arm. This non-fixed end of the lock bar uses a friction interference fit held in place by other assembly components and which allows that side of the link to be removed. The lock bar, or pin and lower link assembly that cooperate with the handle assembly and blade tang makes up the non-fixed, or oscillating pivot.

In another embodiment of the present invention, a folding tool mechanism allows use by either user's hand, and comprises a blade with a cutting edge and a blade tang where the blade tang has a first channel and at least one indent. The mechanism has a handle, with a sheath sized to receive the blade, and the handle houses a second channel. The blade and handle articulate about a main pivot between an open and a closed, or folded and unfolded position and at the end of the articulation a stop post will engage with the blade tang indent and either hold the blade open or closed. The user initiates this movement by lifting a lever via a lever grip which is joined with the handle via a lever-to-handle pivot (also called a handle-to-lever pivot). For additional structural support, the blade tang has walls that abut and interface with the lever at various stages of blade use or storage. The pivoting lever initiates movement of a link which is affixed at one end of an oscillating pivot pin (also called a lock bar). Only one end of the pin is affixed to the link which is preferably comprised of a two-part link arm. The second end of the pin is not affixed but is held by an interference fit of the other assembly components. This pin moves within a first channel and a second channel to move the knife about the main pivot. Because the preferred embodiment moves a knife between two positions, it is described as an oscillating pivot motion. The knife is locked when the lock bar is received in at least one groove on either end of the channels, which grooves correspond to an open position and a closed position. The blade is reversed and actuated from the blade first position to the blade second position by the introduction of momentum from the repetition of the user single action. With the same action, the lever is again pivoted away from the handle at the lever-to-handle pivot and restarts the motion described above. The single action typically calls for a snap of the wrist or arm when the lever grip is grasped by the thumb and finger of either hand.

More specifically, and in a presently preferred embodiment, by way of example and not necessarily by way of limitation, the user initiates the blade motion by flicking his wrist which releases at least one ball-like catch from cooperating recesses and pulls the lever away from the handle. The action begins the movement of a lock bar through channels in the blade tang and the knife handle liner due to the transfer of momentum to the floating pin. The channels have grooves which cause the blade to stop at predetermined locations. The predetermined locations will allow the tool to be articulated and either put to use or safely stored. The momentum initiated by the same motion—a flick or snap of the wrist—disengages the lock bar from lock grooves in the liners and the groove in the blade tang so that the blade may reverse the motion. Additional support is provided for the blade due to a direct interface and point of contact between the lever and the blade. The blade tang has built-in indents to receive blade stop posts for each of the relative blade locations. In some embodiments, knives may be equipped with a pocket clip attachment and a hole to receive a lanyard.

The foregoing has outlined, in general, the physical aspects of the invention and is to serve as an aid to better understanding the more complete detailed description which is to follow. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings further describe by illustration, the advantages and objects of the present invention. Each drawing is referenced by corresponding figure reference characters within the "DETAILED DESCRIPTION OF THE INVENTION" section to follow.

LIST OF REFERENCE NUMERALS

Figure 1:
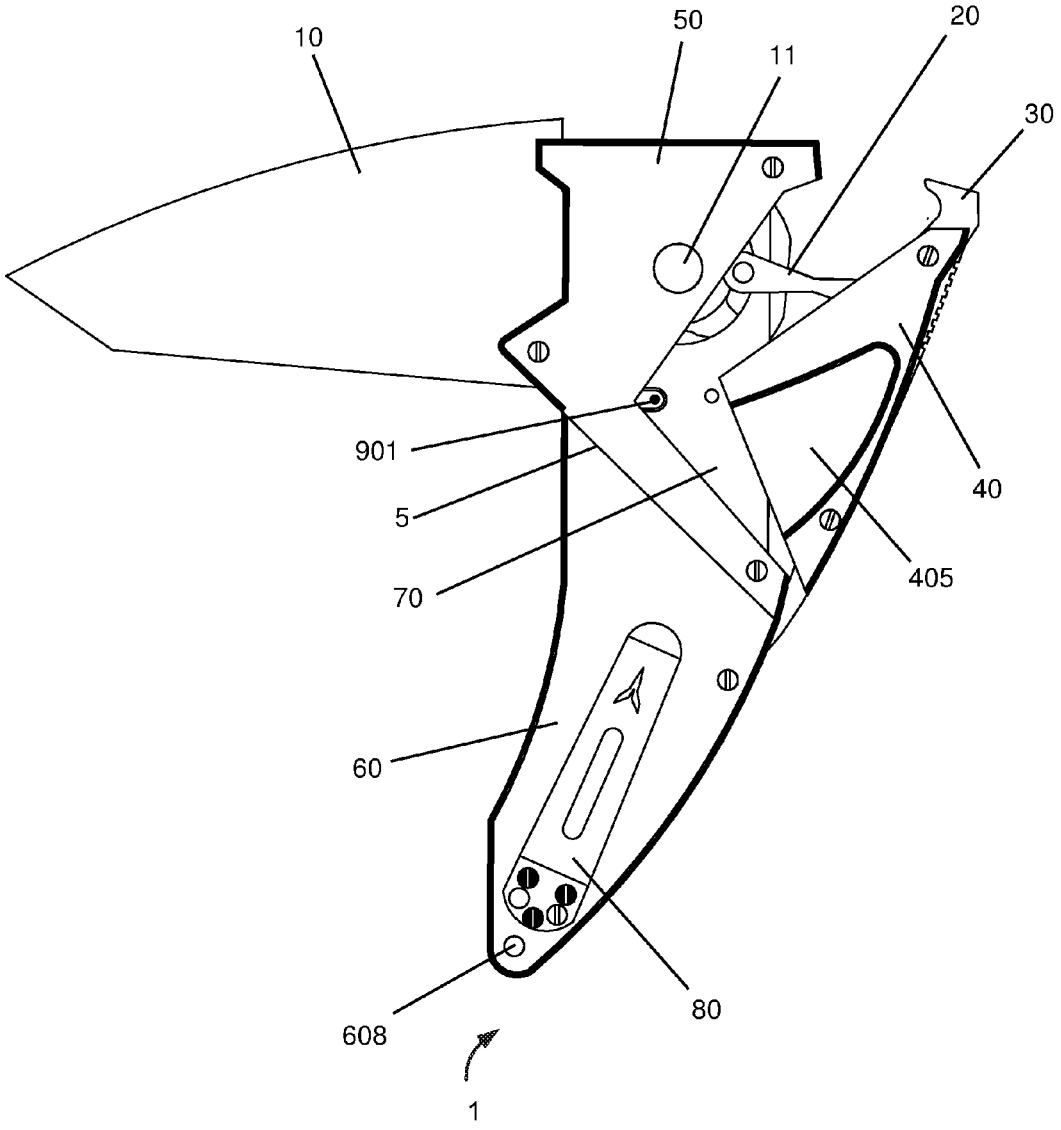
FIG. 1 is the first side plan view of the present invention showing the mechanism action during blade opening and closing.

1 Knife as whole
11 Main pivot
10 Blade
- 101 tang
- 102 pivot axis hole
- 103 precise channel for lock bar
- 104 tang lock-open groove
- 105 tang lock-closed groove
- 106 closed blade-to-stop post interface
- 107 open blade-to-stop post interface
- 108 closed tang-lever interface
- 109 open tang-lever interface
- 110 cutting edge

2 link assembly
20 link arm 1
- 201 Link-to-lever pivot axis
- 202 non-fixed lock bar attachment

21 link arm 2
- 211 Link-to-lever pivot axis
- 212 fixed lock bar attachment
- 221 lever/link pivot bar
- 222 lock bar

3 lever assembly
30 lever arm
- 301 Link-to-lever pivot axis
- 302 open blade interface
- 303 closed blade interface
- 304 Lever-to-handle pivot axis
- 305 assembly hole
- 306 assembly hole
- 307 Lever-to-handle pivot bar
- 308 machined texture

40 Lever Grip 1
- 401 lever/link pivot recess
- 402 cutout for link lock bar movement
- 403 ball catch recess
- 404 cut out for liner clearance
- 405 finger hold
- 406 assembly hole
- 407 assembly hole

41 Lever Grip 2
- 411 lever/link pivot recess
- 412 cutout for link lock bar movement
- 413 ball catch recess
- 414 cut out for liner clearance
- 415 finger hold
- 416 assembly hole
- 417 assembly hole

5 Handle Assembly
50 Bolster 1
- 501 cut out for link lock bar movement
- 502 blade pivot hole
- 503 pivot head recess
- 504 bolster recess for handle insert
- 505 assembly hole
- 506 assembly hole
- 507 assembly hole

51 Bolster 2
- 511 cut out for link lock bar movement
- 512 blade pivot hole
- 513 pivot head recess
- 514 bolster recess for handle insert
- 515 assembly hole
- 516 assembly hole
- 517 assembly hole

60 Handle 1
- 601 handle insert
- 602 lever/handle pivot recess
- 603 assembly hole
- 604 assembly hole
- 605 pocket clip attachment hole
- 606 pocket clip attachment hole
- 607 pocket clip attachment hole
- 608 lanyard hole

61 Handle 2
- 611 handle insert
- 612 lever/handle pivot recess
- 613 assembly hole
- 614 assembly hole
- 615 pocket clip attachment hole
- 616 pocket clip attachment hole
- 617 pocket clip attachment hole
- 618 lanyard hole

70 Liner 1
- 701 precise channel lock bar guide
- 702 closed lock bar liner groove
- 703 open lock bar liner groove
- 704 pivot hole
- 705 open blade stop hole
- 706 closed blade stop hole
- 707 ball insert
- 708 precise channel for ball catch
- 709 lever/handle pivot hole
- 710 assembly hole
- 711 assembly hole
- 712 assembly hole
- 713 assembly hole
- 714 assembly hole
- 715 pocket clip attachment hole
- 716 pocket clip attachment hole
- 717 pocket clip attachment hole

718 lanyard hole
72 Liner 2
721 precise channel lock bar guide
722 closed lock bar groove of liner channel
723 open lock bar groove of liner channel
724 pivot hole
725 open blade stop hole
726 closed blade stop hole
727 ball insert
728 precise channel for ball catch
729 lever/handle pivot hole
730 assembly hole
731 assembly hole
732 assembly hole
733 assembly hole
734 assembly hole
735 pocket clip attachment hole
736 pocket clip attachment hole
737 pocket clip attachment hole
738 lanyard hole
80 Pocket clip
801 pocket clip attachment hole
802 pocket clip attachment hole
803 pocket clip attachment hole
90 Hardware
901 ball catch
902 blade washer
903 blade pivot hole
904 interior link/lever alignment spacer
905 link/lever pivot hole
906 exterior link/lever alignment spacer
907 link/lever pivot hole
908 lock bar washer
909 lock bar washer hole
910 handle/lever washer
911 handle/lever pivot hole
912 blade pivot bolt
913 blade pivot head
914 blade pivot screw
915 blade open stop post
916 threaded standoff spacer
917 assembly screw
918 pocket clip assembly screw
919 blade closed stop post

DETAILED DESCRIPTION OF THE INVENTION

Figure 2:
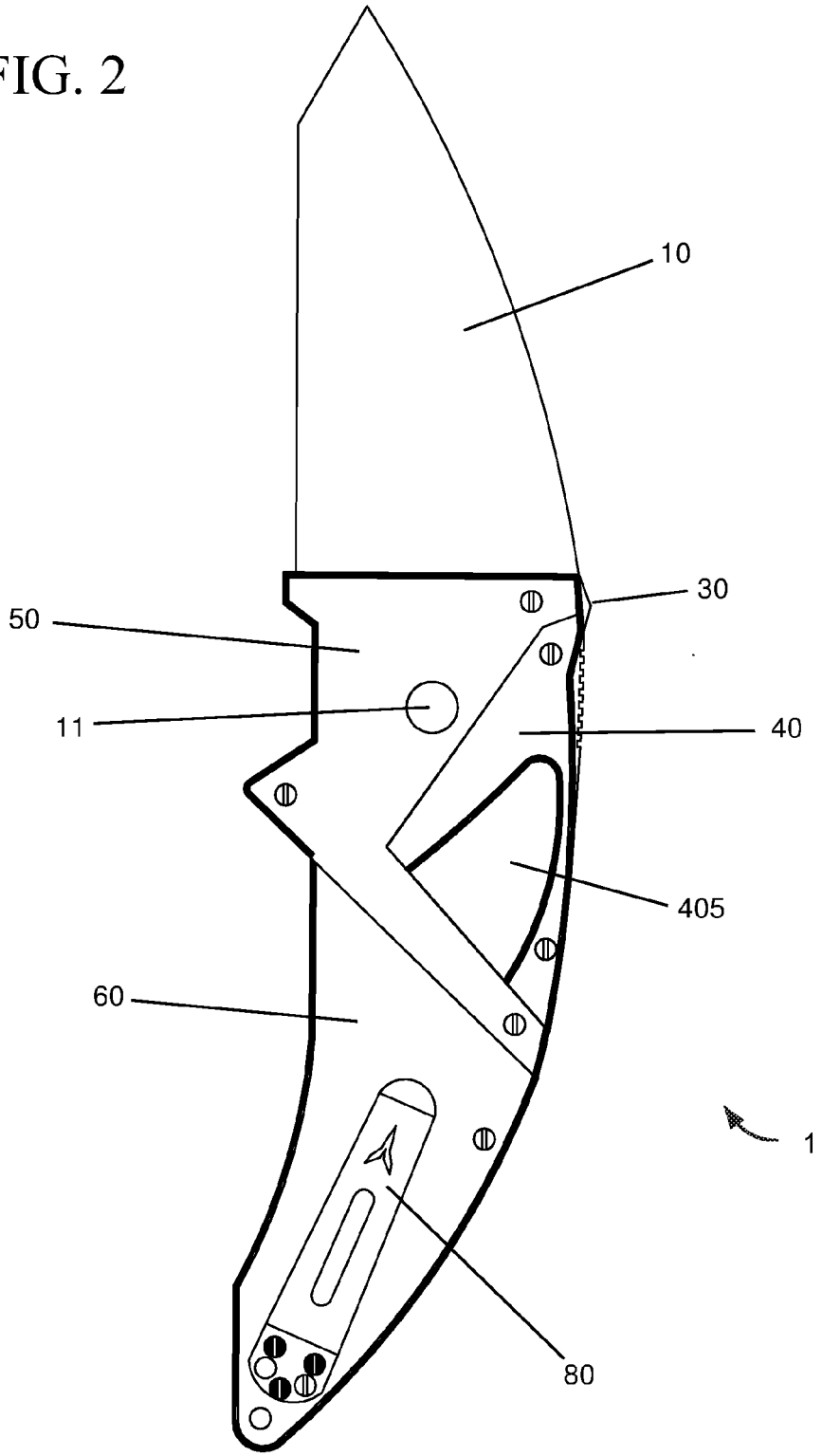
FIG. 2 is a side plan view of the present invention showing a blade in an open position.
Figure 3:
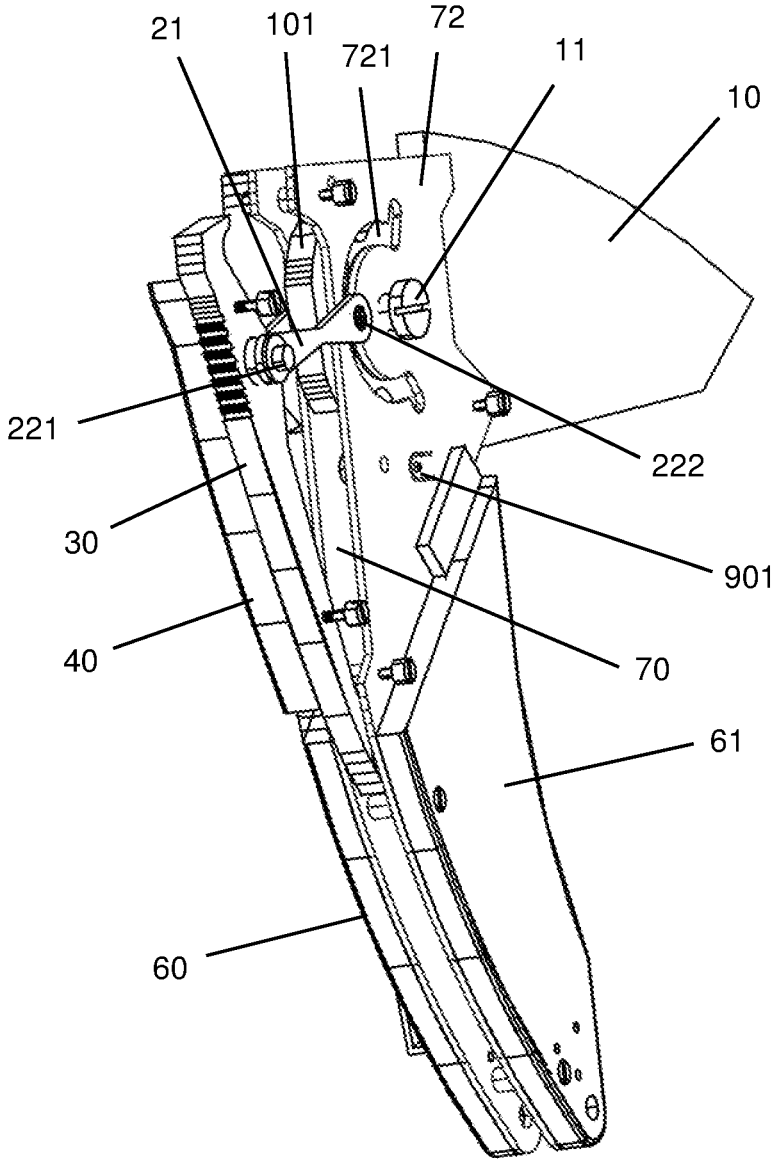
FIG. 3 is the second side, rear perspective view of the present invention showing the blade action during opening or closing. For illustrative purposes, one lever grip and one bolster have been removed to reveal the link and lever assemblies.
Figure 4:
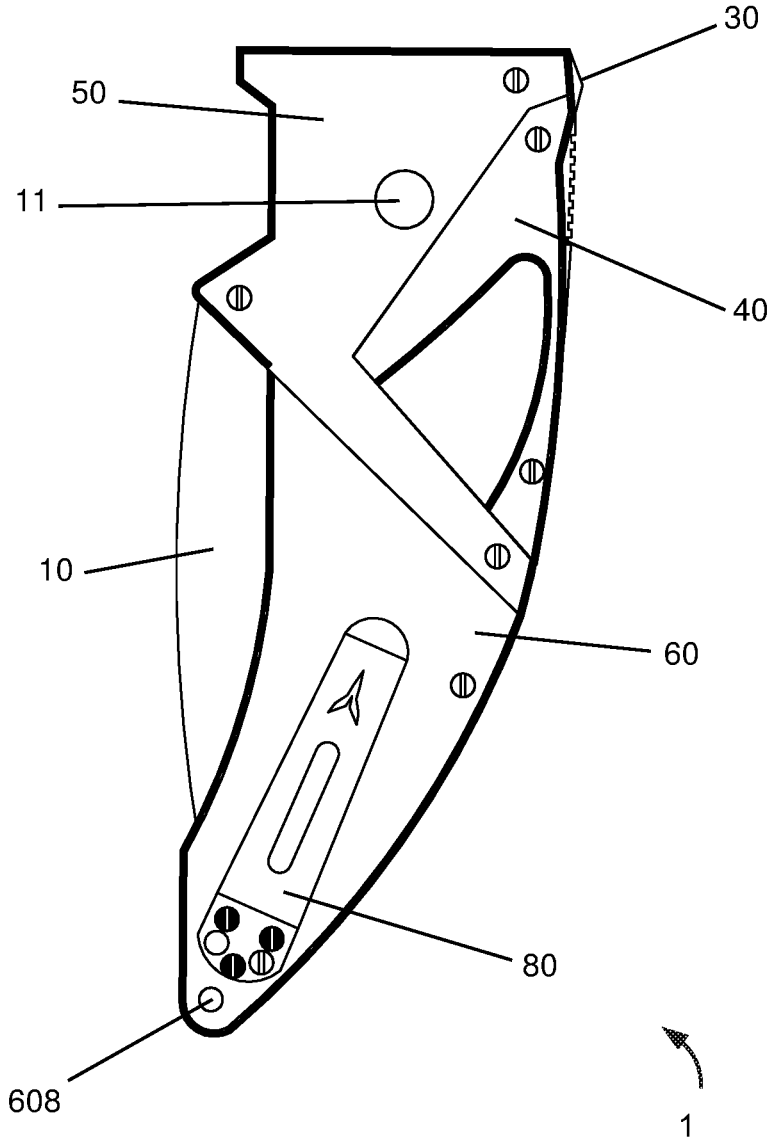
FIG. 4 is a side plan view of the present invention where the blade is enclosed in the handle assembly in a closed position.

The unique lever assembly 3 and link assembly 2 actuating means of the present folding knife mechanism can be glimpsed as the knife 1 folds and unfolds around its pivot axis 11 as is demonstrated in FIGS. 1 and 3. In FIG. 1, an opaque knife is shown traveling through such an action, while the internal detail of that action can be viewed in the tear away view shown in FIG. 3 and the transparent model shown in FIGS. 5-7. The action of opening and closing the knife is begun by the momentum from the flick or snap of a user's wrist or a forward thrust of the user's hand or arm. While grasping the finger holds 405, 415 of the lever grip 40, 41, a wrist snap will provide the force to move the lever 30 away from the handle assembly 5 as is shown in FIGS. 1 and 3. The pivoting of the cleat-like, open and closed blade interface 302, 303 away from the handle via the handle-to-lever pivot initiates the movement of the link assembly 2 to open or close the knife. In FIG. 2, the knife has been moved to an open position and is ready for use. In FIG. 4, the knife has been moved to a closed position and is ready for storage.

As demonstrated in FIGS. 1-4, the knife 1 is comprised primarily of a blade 10, a link assembly 2, a lever 30, a lever grip 40, a bolster 50, a handle 60, a liner 70, an optional pocket clip 80, and fasteners and hardware to join the parts together. In the preferred embodiment, some of the primary parts are provided in pairs to contain the blade 10 and the moving parts of the knife mechanism. A comparison of the first side and second side views in FIGS. 1 and 27, respectively, illustrates some first and then second items of the knife mechanism. In the preferred embodiment there are two link arms, 20, 21 (see also FIG. 20); two lever grips 40, 41 (see also FIGS. 22-25); two bolsters 50, 51 (see also FIGS. 22-25); two handles 60, 61 (see also FIGS. 22-25); and two liners 70, 72 (see also FIGS. 17-18). For many of these larger parts there will also occur a duplication in the finer components and hardware. See, e.g., FIGS. 8, 9, 12, and 26.

FIGS. 1, 2, and 4 show the superficial changes that occur to the knife while it is opening and closing. The rear perspective view of FIG. 3 has one lever grip 41 and one bolster 51 removed to reveal the inner workings that get the knife through the motion illustrated in FIGS. 1, 2 and 4. With the flick of a wrist, the lever 30 pulls away from the handle assembly 5. The lever 30 is at its furthest point away from the handle assembly in the middle of the motion of the blade 10. See FIGS. 1 and 3. The blade 10 moves from either an open to closed or closed to open position. Then, the motion is repeated to move the blade from a closed to open or open to closed position. Only one hand is used and very little dexterity is required. The inner workings of the lever and link assemblies which cause the motion of the blade 10 are not visible to the naked eye during use.

Figure 5:
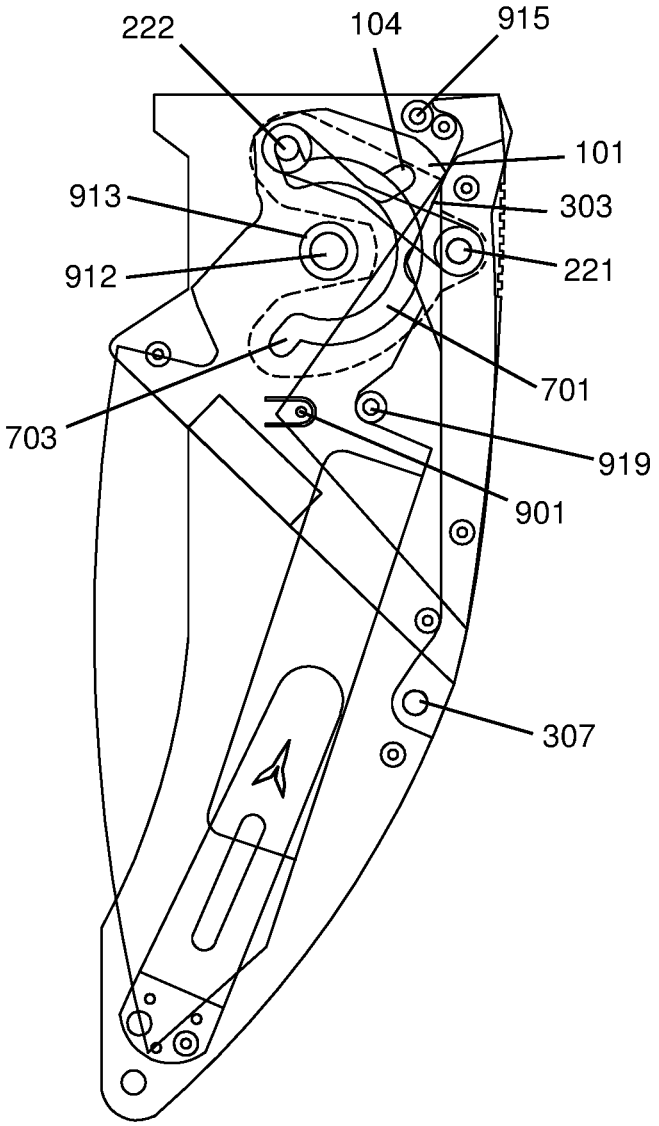
FIG. 5 is a side plan view of the present invention as shown in FIG. 4, but with all the internal components of the mechanism schematically represented.
Figure 6:
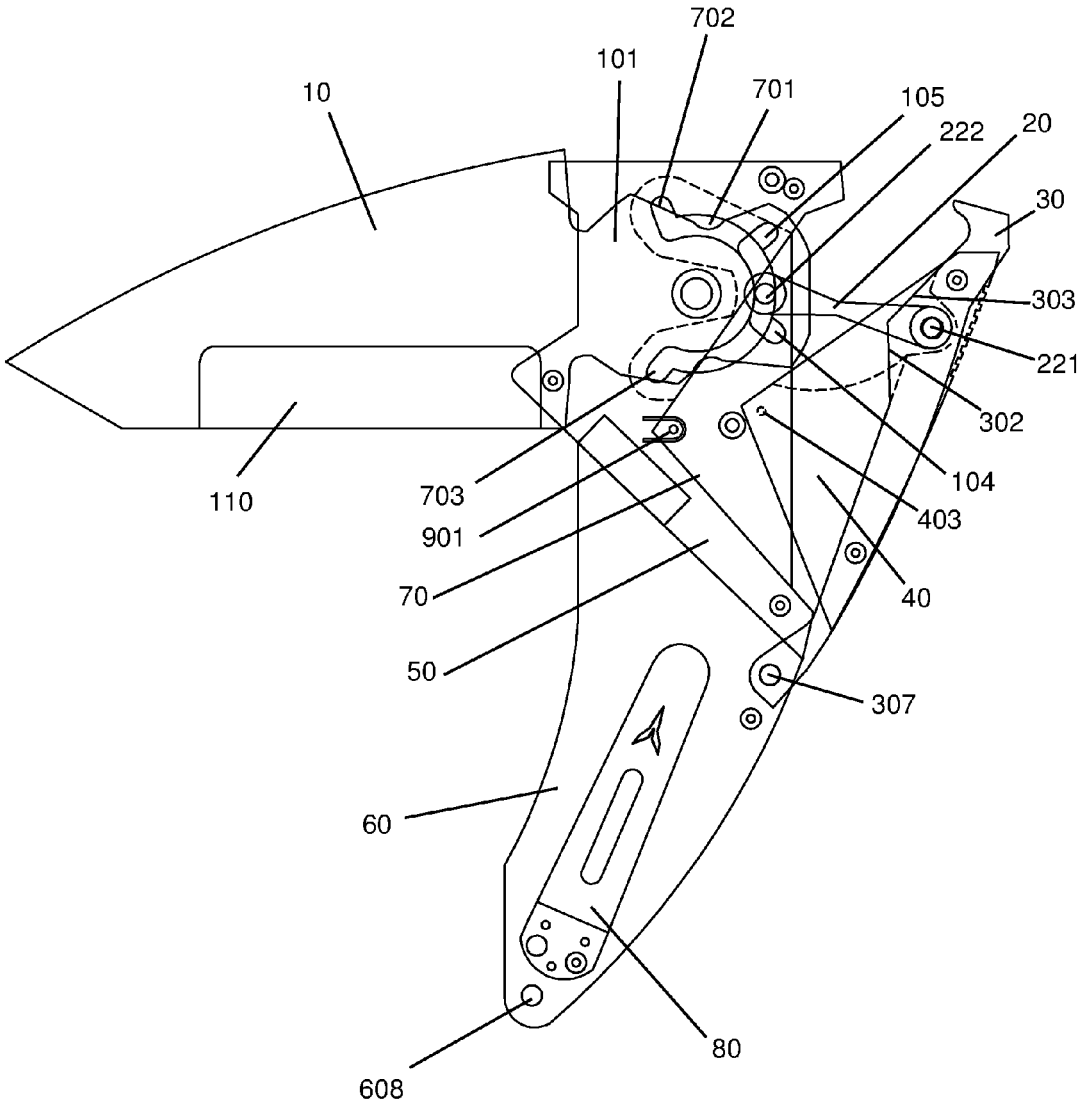
FIG. 6 is a side plan view of the present invention as shown in FIG. 1, but with the internal components of the mechanism schematically represented.
Figure 7:
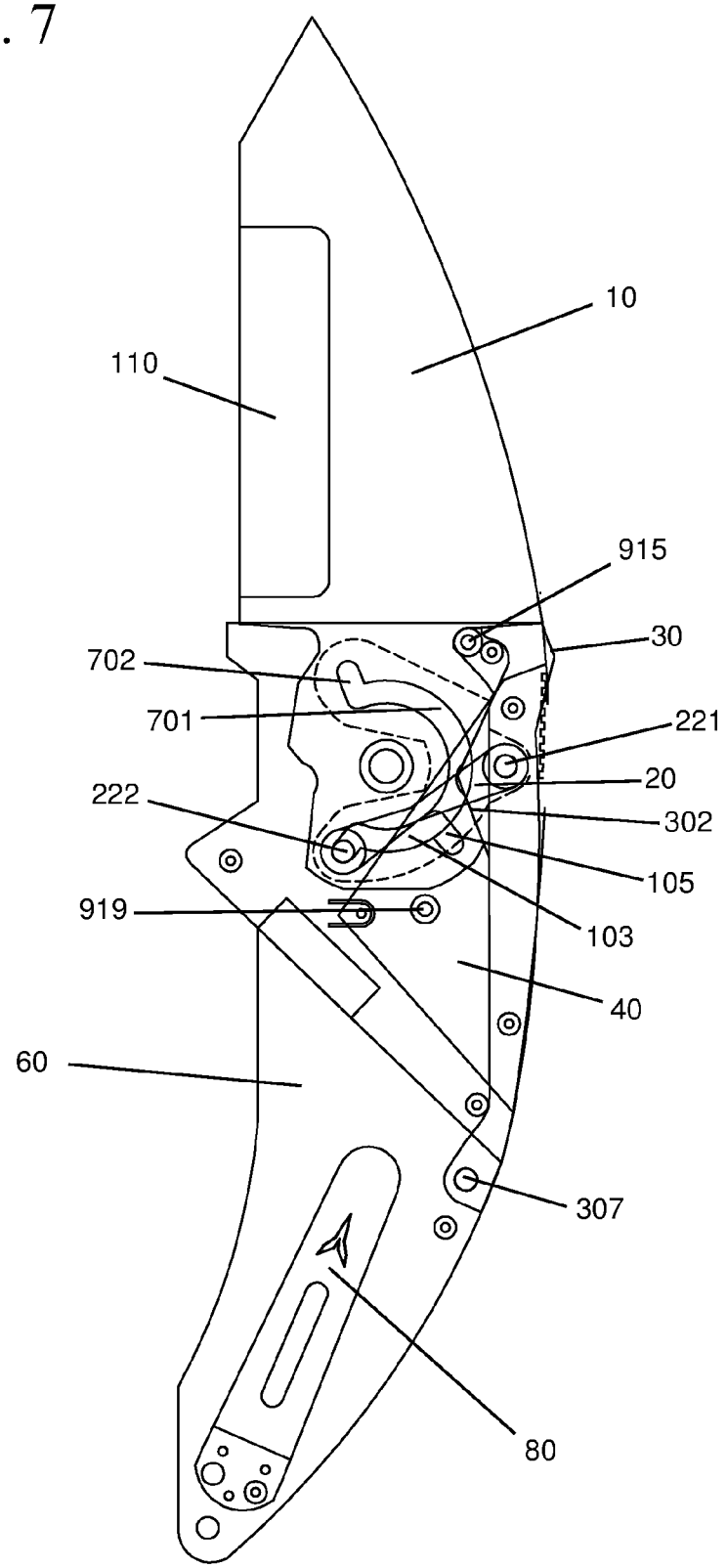
FIG. 7 is a side plan view of the present invention as shown in FIG. 2, but with the internal components of the mechanism schematically represented.

Reference to the tear away view of FIG. 3 and the transparent schematic representations of the knife in FIGS. 5-7 will assist in the explanation of the unique knife mechanism employed. Referring to FIGS. 5-7, during preferred use, a user manipulates the knife mechanism and opens the knife or closes the knife with a single action while the knife 1 is held in either hand. The handle assembly 5 consisting of bolster 50, 51 and handle 60, 61 of the knife 1 are moved away from the lever 30 when a user grasps the lever finger hold 405, 415 of the lever grip 40, 41 affixed to the lever 30 and snaps his wrist as though throwing a yo-yo and providing a forward thrust from his arm and elbow as he holds onto the grip of the lever, thereby kicking the blade 10 out of the handle assembly. The action disengages one or more small, dome-like ball catches 901 which lie in a ball indent 707, 727 in the liners 70, 72, from the tension fit created with the respective recesses 403, 413 on the underside to the lever grip 40, 41. See FIGS. 17-18, 25. Specifically, when the knife begins in a closed position as shown in FIG. 5, the initial action also pivots the lever blade interface 302 away from the closed tang-lever interface 108 of the blade tang 101. This closed-to-open articulation of the knife disengages a lock bar, or oscillating pin 222 from the liner lock-closed grooves 702 and 722 and the tang lock-closed groove 105 (see FIGS. 6-7, 17-19 for additional component numbers). As the lever 30 continues pivoting away from the bolster 50, 51, the lock bar 222 continues traveling along the lock bar guide or channel 701, 721 in the liner 70, 72 and also within the precise channel 103 in the tang 101 of the blade 10. FIGS. 3 and 6 illustrate the mechanism when the lever 30 has traveled to the farthest point away from the handle and the lock bar 222 is active within the liner guide channel 701, 721 and tang channel 103. As the blade 10 continues to travel from a closed to an open position, the lock bar 222 is simultaneously engaged with the blade tang channel 103 and the liner guide channel 701, 721 and moves toward the liner lock-open grooves 703, 723 and the tang lock-open groove 104. At the end of the blade mechanism articulation, the lever returns or pivots back toward the handle and it forces the lock bar, or pin 222 to seat into the applicable liner and tang lock grooves. In FIG. 7, the lock bar 222 has reached the liner lock-open groove 703, 723 and the tang lock-open groove 104. As the lock bar 222 ends its travel in the liner guide channel 701, 721, its position is secured in the liner lock grooves 703, 723 and the tang lock groove 104. The blade 10 is locked into place as the lever 30 pushes back into contact with the bolster 50, 51 of the handle assembly 5 and the blade tang 101. The lever interface 302, 303 makes contact with the open tang-lever interface 109 and the ball catch 901 settles into the recess 403, 413 in the lever grip 40, 41. See the open position illustrated in FIG. 7 where the cutting surface edge 110 of the blade 10 is represented.

The closing of the blade would be initiated with the repetition of the same user-initiated action which momentum reverses the mechanism. The ball catch 901 is released from the tension created with the lever grip recesses 403, 413 and the lever 30 pulls away from the handle assembly 5. Meanwhile, the open blade stop indent 107 dislodges from the open blade stop post 915. As the lever 30 pivots away from the handle assembly 5, the lever-to-link pivot 221 pulls the link arms 20, 21 which dislodge the lock bar 222 out of the liner lock-open grooves 703, 723 and the tang lock-open groove 104 and into the liner channel 701, 721 and tang channel 103. The lock bar 222 travels toward the opposing grooves in the respective channels. The lever 30 moves back toward the handle assembly 5 and tang 101. The lock bar 222 ends its travel in the channels when the lever 30 pivots back toward the handle assembly 5 and pushes the lock bar 222 into the liner lock-closed grooves 702, 722 and tang lock-closed groove 105. The ball catch 901 again engages its lever grip recesses 403, 413 and the closed blade stop indent 106 abuts the closed stop post 919. Pressure between the tang and lever interfaces aid the secure storage of the closed knife 1 within the handle assembly 5. The details of the various structures shown in FIGS. 5-7 can be further understood by a review of the exploded view of the major components as demonstrated in FIG. 8. The various pivots and spacers are shown in FIG. 8.

Figure 8:
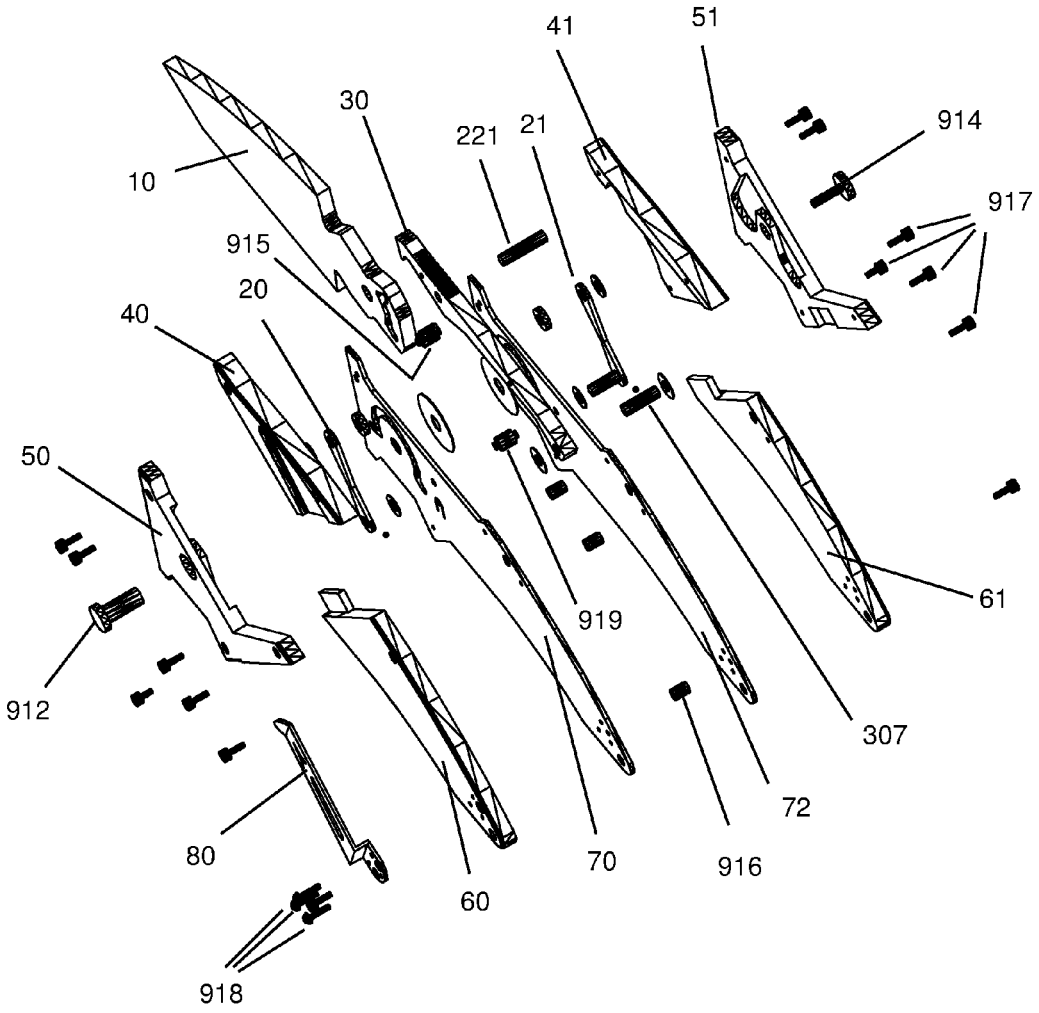
FIG. 8 is an exploded, top perspective view schematically demonstrating the complete internal components of the present invention according to the preferred embodiment.
Figure 9:
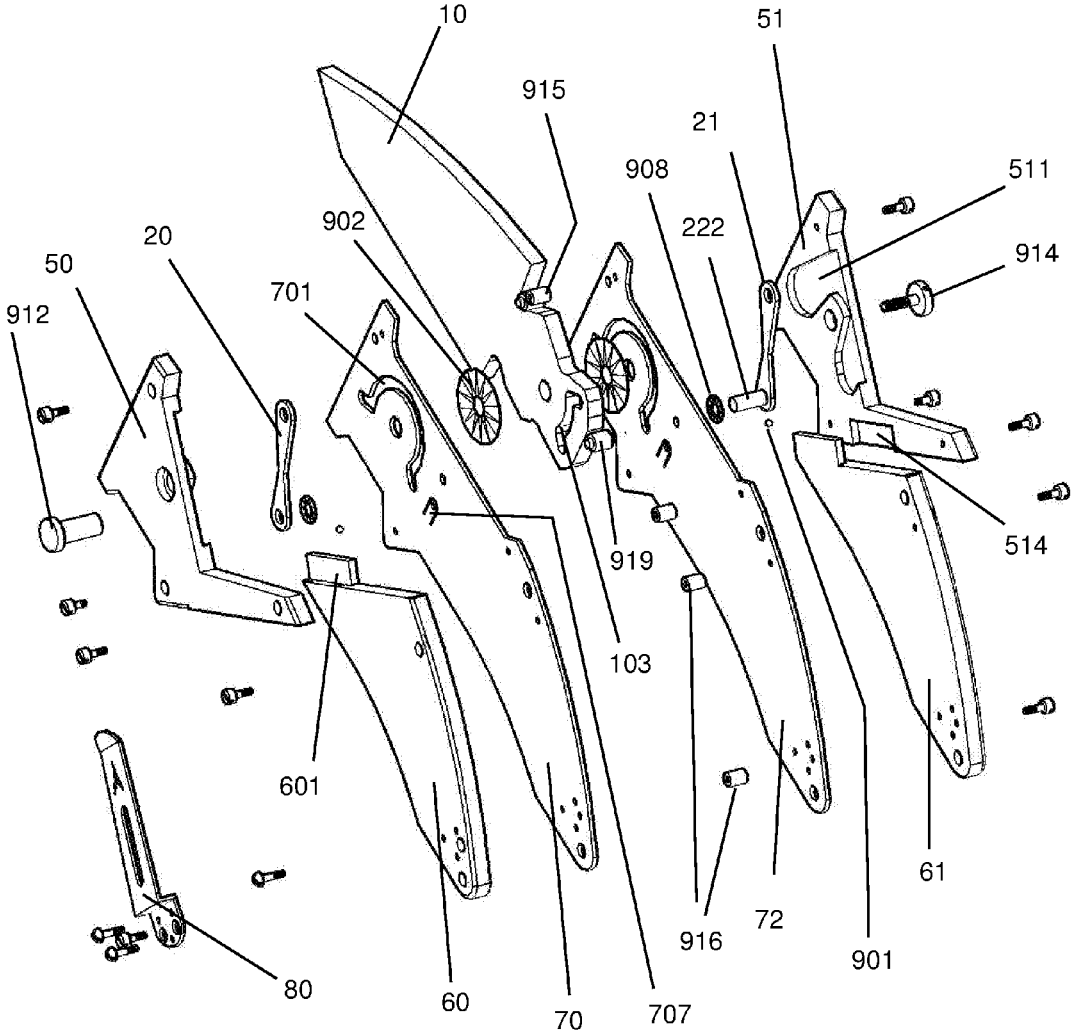
FIG. 9 is an exploded, side perspective view demonstrating the handle assembly of the present invention with all of the internal components of the mechanism schematically represented.
Figure 10:
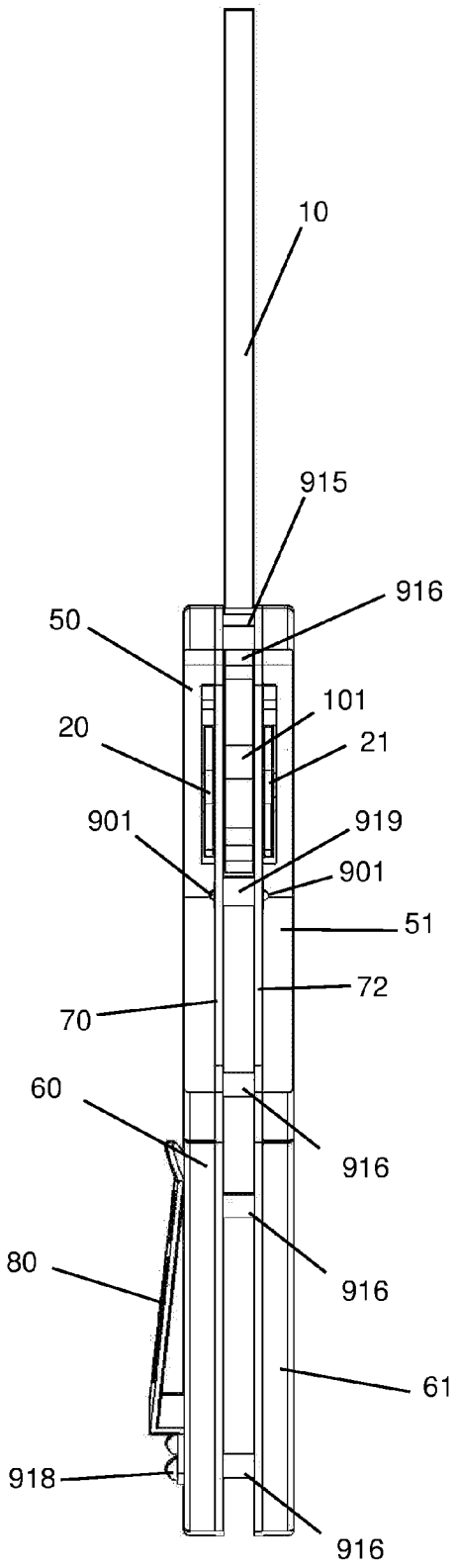
FIG. 10 is a top plan view of the handle assembly of the present invention with the lever assembly omitted to reveal underlying structures.
Figure 11:
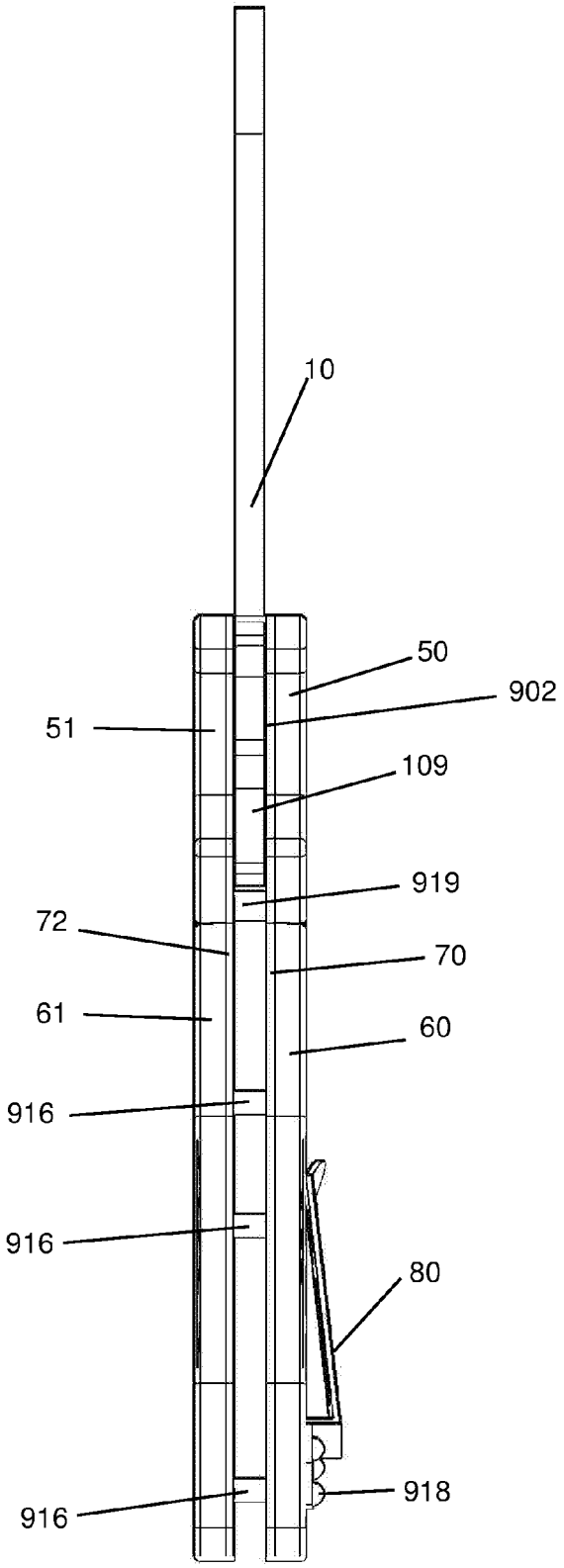
FIG. 11 is a bottom plan view of the handle assembly as shown in FIG. 10.

The construction of the preferred embodiment can be appreciated from the exploded perspectives views of FIGS. 8 and 9. FIG. 9 demonstrates the components other than the lever 30 which would lie toward the top of the knife as related in FIG. 8. Likewise, the lever assembly 3 is omitted from FIGS. 10-11 so that additional structures of the handle assembly 5 are visible. Referring to FIGS. 9-11, a tool blade 10 will be sheathed between two liners 70, 72 which are buffered by the use of hardware such as washers 902 and several spacers 916 so that the blade 10 may rotate freely around a main pivot point 11. The main pivot 11 of the preferred embodiment is comprised of the blade pivot bolt 912 which traverses the entire knife 1 and is comprised of a blade tang hole 102, a set of washer holes 903, respective liner holes 704, 724, and the bolster pivot holes 502, 512. The blade pivot bolt 912 receives the blade pivot screw 914 and the pivot head 913 maintains the pivot hardware in place (see FIGS. 17-19, and 26 for additional component numbers). This description is provided by way of example and not limitation, the pivot may be constructed in any manner to allow the rotation of the blade for use, however, in the preferred embodiment a series of holes and fasteners and finally, an open stop post 915 and closed stop post 919 allow the blade to pivot within a pre-set axis of rotation. As shown in FIGS. 9-11, the handle assembly 5 is sandwiched around the liners 70, 72 and is comprised primarily of two handles 60, 61 and two bolsters 50, 51. Interior molding or cut-outs in the inner walls of the handles 60, 61 and bolsters 50, 51 permit the nesting of the relative pieces and also permit important space necessary for the operation of the link 20, 21 and the lock bar 222 within the knife mechanism. As shown in FIG. 8 and also demonstrated in FIG. 3, the lever assembly 3 lies atop the knife 1. The lever assembly 3 also interfaces with the blade tang 101 as well as the liners 70, 72 and the handle assembly 5. See FIGS. 1-7. The sides of the lever 30 will be relatively flush with the outer surface of the handle assembly 5 as may be viewed in the end views of FIGS. 15-16. The relationship of the exterior faces of the preferred embodiment are demonstrated in FIGS. 10-11, and 13-16.

The omission of the lever assembly 3 in the top plan view of the handle assembly 5 in FIG. 10 reveals more components of the link assembly 2 and the composition of the blade housing. The blade 10 pivots around the blade pivot 11 and is stopped in its open position by a blade open stop post 915. A second, blade closed stop post 919 is shown near the center of FIG. 10. Small ball catches 901 are pressed into ball inserts 707, 727 on either side of the blade liners 70, 72 and then the links 20, 21 are located on either side of the lock bar 222. Spacers 916 are sized to hold the liners 70, 72 apart a sufficient distance to receive the blade 10 when it is folded into the handle assembly 5. Similar to FIG. 10, FIG. 11 is a bottom plan view of the handle assembly 5 and although very little of the lever 30 would be visible from the bottom of the knife 1, the lever 30 is removed from this view as well. The bottom of the spacers 916 are again shown holding the liners 70, 72 apart. The bolsters 50, 51 and the handles 60, 61 cover the liners 70, 72 and other working components of the knife 1. On the exterior of either handle 60, 61, a pocket clip 80 may be affixed with a pocket clip assembly screw 918 or other device. Likewise, a hole 618 for accessories such the attachment of a lanyard, key ring, or other item is provided near the rear of the knife.

Figure 12:
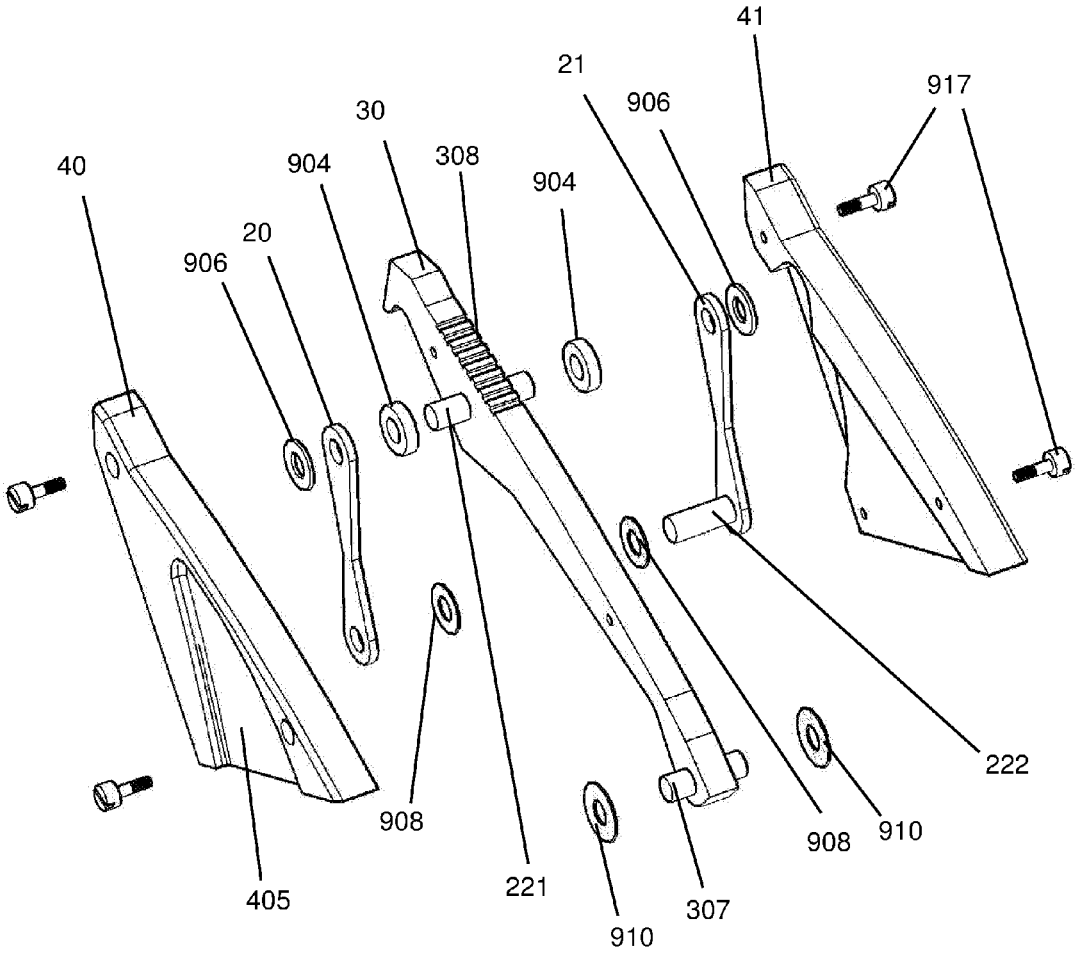
FIG. 12 is an exploded, top perspective view of the link and lever assembly of the present invention shown in isolation.
Figure 13:
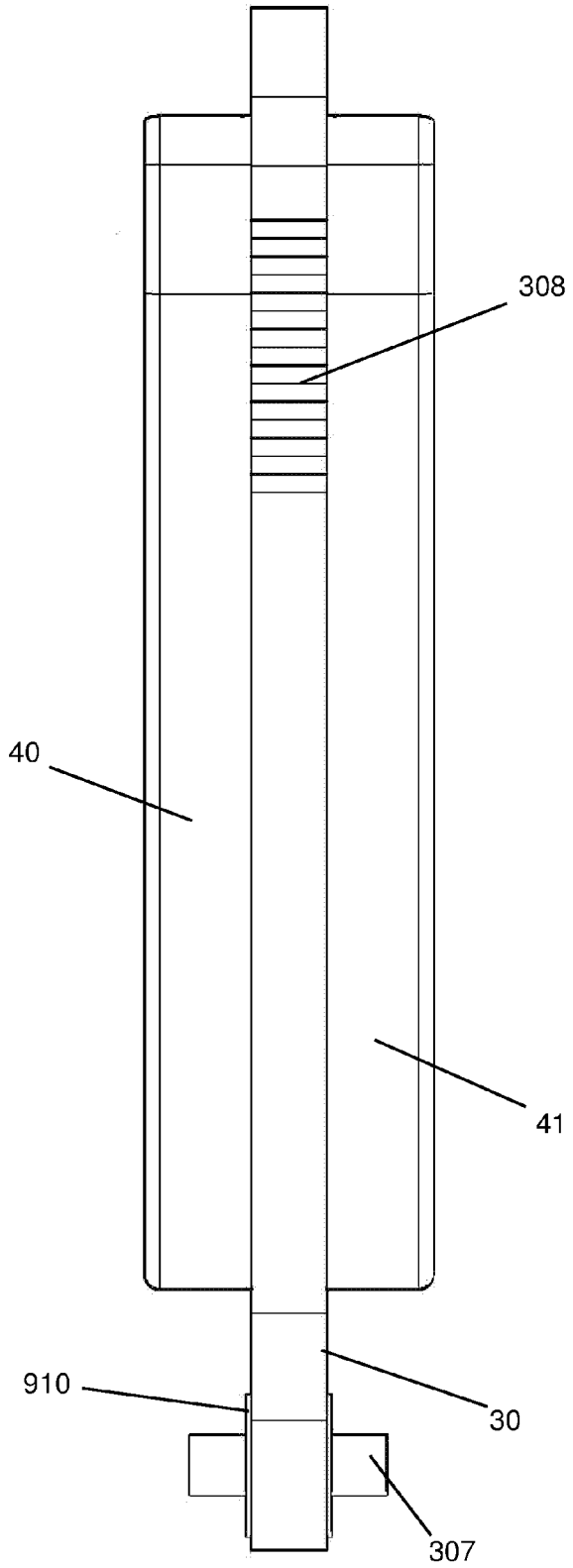
FIG. 13 is a top plan view of the link and lever assembly shown in isolation.
Figure 14:
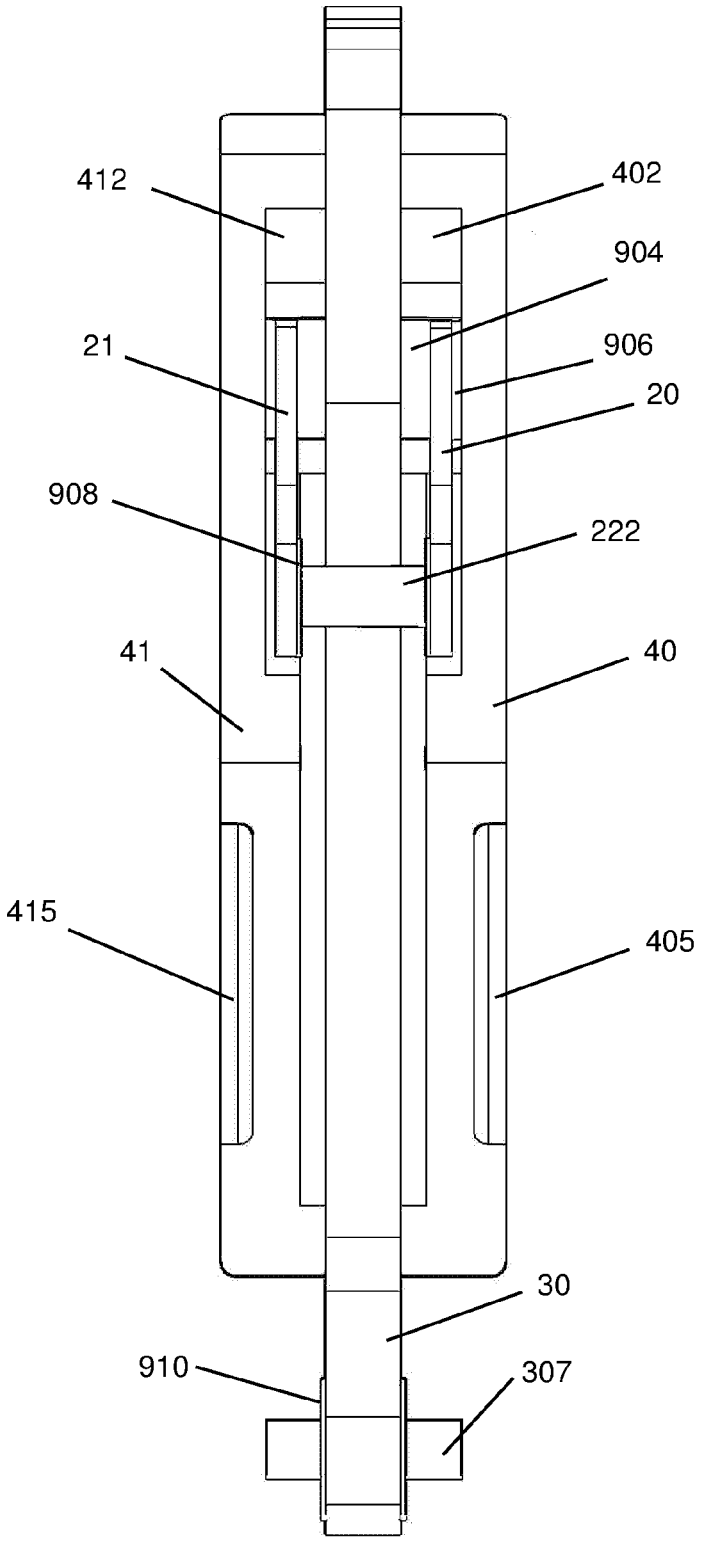
FIG. 14 is a bottom plan view of the link and lever assembly shown in isolation.
Figure 20:
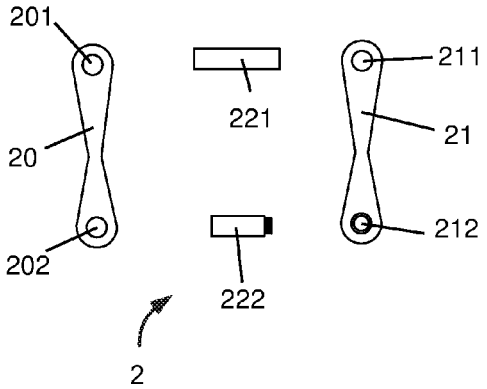
FIG. 20 is a plan view of two links and the corresponding fixed pivot axis and non-fixed pivot of the lock bar, or floating pin of present invention shown in isolation and laid open.

The lever and link assembly is detailed in FIG. 12 and when combined with the handle assembly features shown in FIGS. 9-11 complete the preferred embodiment of the present invention. The link assembly 2 is comprised of two link arms 20, 21. In the preferred embodiment these link arms 20, 21 are substantially shaped like a figure-eight where holes occur in each end of the arm. The details of the link arms 20, 21 are shown in FIG. 20. Referring to FIG. 20, the first set of holes in the respective arms 20, 21 serve as a fixed, link-to-lever pivot axis 201, 211 and receive the link-to-lever pivot bar 221 which traverses the link/lever pivot axis 301 in the lever 30. In the preferred embodiment, the set of holes at the other end of the respective figure-eight shaped arms 20, 21 serve as attachment points, 202, 212 to receive the projecting tube structure called the lock bar or oscillating pin 222 which moves in the channels of the handle and blade. The lock bar or pin 222 is affixed to the attachment point 212 on one link arm 21 and is held in place to the attachment point 202 on the other link arm 20 by the same fitting of the respective knife assembly parts, spacers, and screws. Having one end of the lever-to-link arm fixed reduces overall play in the knife mechanism and prevents unintended slipping of the lock bar 222 out of the channels and grooves. Note, the lever 3 and link 2 assemblies would not be combined for use as shown in FIG. 12 without first inserting the lock bar 222 through the respective liner channels 701, 721 and the blade tang channel 103 as the lock bar 222 is primarily responsible for initiating the pivoting movement of the blade 10. The movement is aided by the addition of spacers 904, 906, washers 908, 910 and clearance cut outs and covered areas 404, 414 in the lever grips 40, 41—all of which are visible in FIG. 12. Additional room for operation is provided by the bolster cut outs 501, 511 of the bolsters 50, 51 shown in detail in FIGS. 22-25. Assembly screws 917 hold the lever grips 40, 41 to the lever 30 and link assembly but also hold the entire knife assembly in place so that the respective pivots may work. FIG. 13 is a top view of the link and lever assembly shown in isolation as with FIG. 12, meaning without it being joined to the handle assembly 5. The bottom isolated view of the link and lever assembly is illustrated in FIG. 14. Referring to FIG. 13, the machined texture 308 is added to assist in the ergonomic use of the knife 1 when the blade 10 is extended. The texturing along the back side may take any form known in the field, such as jimping, cross-hatching or dimpling, in order to create a non-slip surface grip of the knife for different uses. FIG. 14 also shows the relative positions of the first and second link arms 20, 21 and the lock bar or pin 222 versus the handle-to-lever pivot 307.

Figure 15:
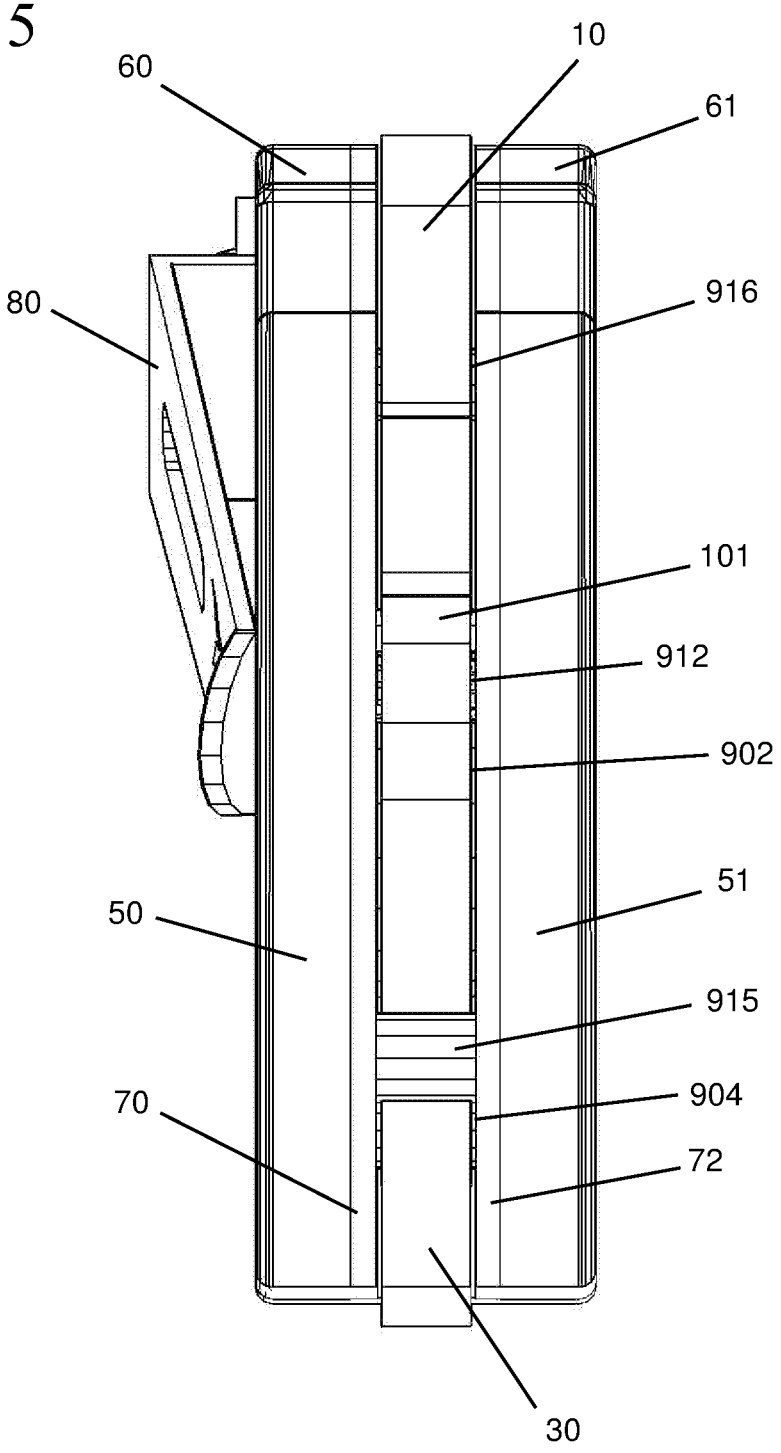
FIG. 15 is a distal end view of the present invention when the blade is in a closed position.
Figure 16:
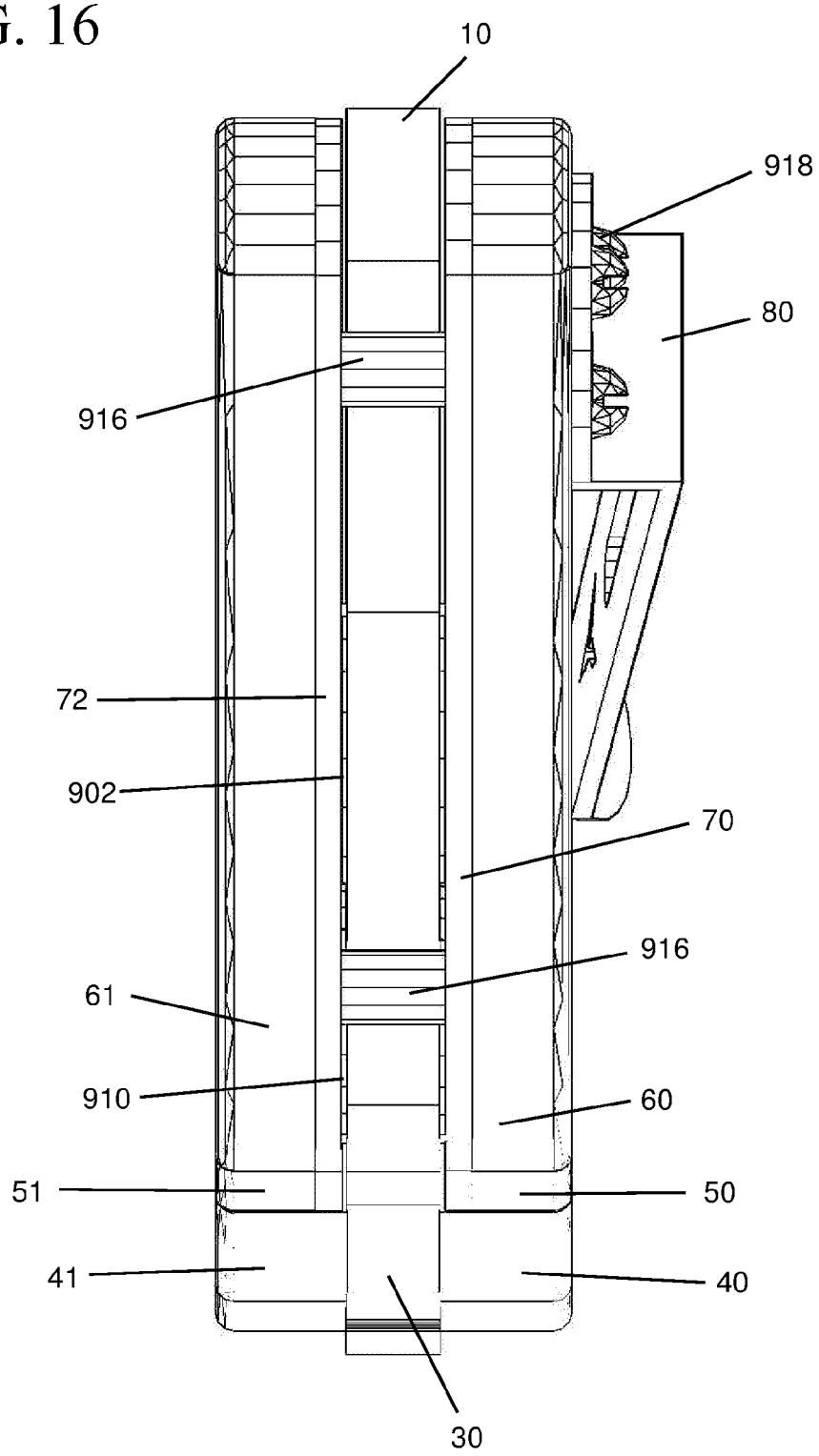
FIG. 16 is a proximal end view of the present invention when the blade is in a closed position.

FIG. 15 is a distal end view of the knife 1 taken while the knife is in a closed position. From this view you can see that when the blade is closed the base of the tang 101 is seen centered between the liners 70, 72 and bolsters 50, 51. Similarly, FIG. 16 is a proximal end view taken from the handle side of the knife. In this view the blade 10 and lever 30 are seen centered between the liners 70, 72 and handles 60, 61 along with the necessary spacers 916. Both FIGS. 15 and 16 show the locations of the various pivots when the knife is closed. The shape, position, and sizing of a typical pocket clip 80 upon the knife 1 is also visible in FIGS. 15-16.

Figure 17:
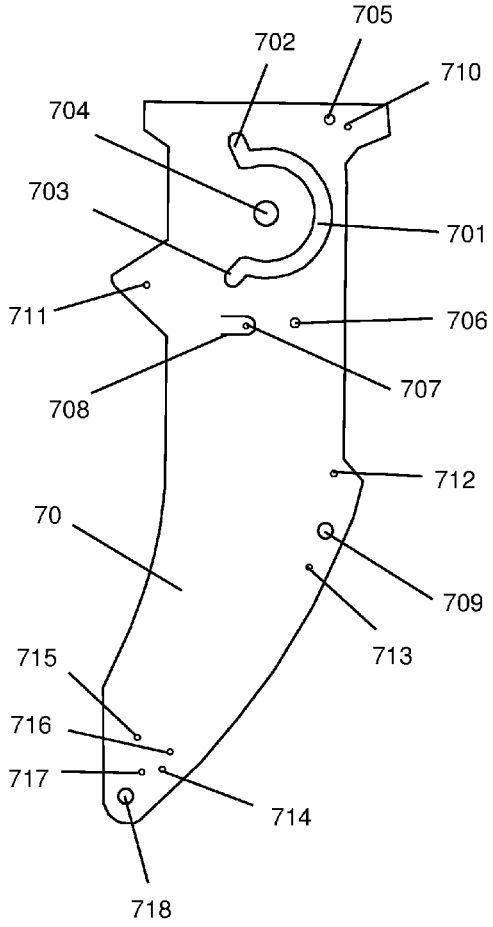
FIG. 17 is a first side view of a liner frame of the handle shown in isolation.
Figure 18:
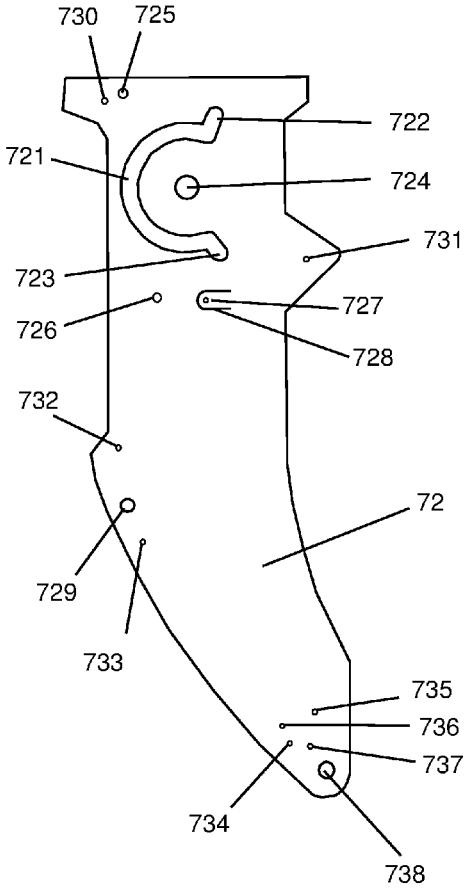
FIG. 18 is a second side view of a liner frame of the handle shown in isolation.

The liners 70, 72 of the present invention are shown in isolation in FIGS. 17-18, respectively. Many various liner or frame shapes and structures may be implemented to meet the objectives of the present invention, FIGS. 17-18 provide but one example as used in the preferred embodiment. A rigid structure will provide the framework for attachment of various other structures, a strong handle for leverage and use of the blade, and a reliable, protective sheath for the blade of a knife. In the preferred embodiment, only the blade 10, washers 902, stop posts 915, 919 and the spacers 916 are placed between the two liners 70, 72. See FIG. 9. Each liner has a precise channel lock bar guide 701, 721 through which the lock bar 222 articulates during opening and closing. The channel 701, 721 is illustrated as traversing the entire surface of the liner, but the channels could simply be inset into a structure such as the handle in order to receive the lock bar pin. Grooves occur at the respective ends of the channels 701, 721. The closed lock bar grooves 702, 722 occur at the top of the guide 701, 721 while the open lock bar liner grooves 703, 723 occur at the bottom of the guide 701, 721 as the liners are oriented in FIGS. 17-18. As previously discussed, the liners 70, 72 anchor the main blade pivot 11 through the liner pivot holes 704, 724. The liners receive the blade open stop post 915 through the open blade stop post holes 705, 725. The stop post for closing the blade, or closed blade stop post 919, joins the liner at the closed blade stop post holes 706, 726. Next, the ball catch insert 707, 727 occurs within the precise channel for the ball catch 708, 728. This precise channel 708, 728 provides a flex in the liner to release or receive the ball catch during operation. The lever-to-handle pivot hole 709, 729 provides the anchor point for the lever-to-handle pivot bar 307 which also traverses the lever 30 and handle 60. Thus, the liners provide the framework for the components which initiate, guide, and stop the relative motion of the blade.

FIGS. 17-18 illustrate one example of an arrangement of assembly holes 710, 730, 711, 731, 712, 732, 713, 733, 714, 734 through which assembly screws 917 may join the relative parts. The assembly screws 917, together with other components, create a press-fit arrangement which holds the handle-to-lever, and lever-to-link pivots in place and also holds the lock bar 222 within the channels and grooves. While the preferred embodiment calls for two liners, a single liner could be formed to accomplish the same objectives and is covered by this disclosure. In the instance where a single liner or a hi-folded liner was used, some holes and parts may not be needed or used in duplicate. If one or more pocket clip 80 is used the pocket clip attachment holes 715, 735, 716, 736, 717, 737 may be incorporated into the liners 70, 72. Similarly, if a lanyard option is desired, lanyard holes 718, 738 may be incorporated toward the bottom of the liners 70, 72.

Figure 19:
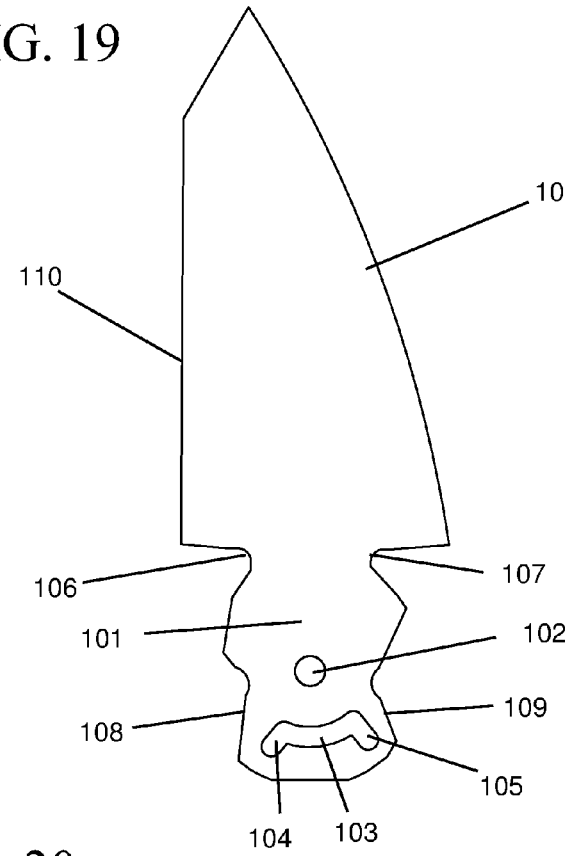
FIG. 19 is a side plan view of a blade shown in isolation.

An isolated blade 10 is illustrated in FIG. 19. The blade 10 is comprised of a cutting edge 110, a tang 101, a pivot axis hole 102, and a precise channel for the lock bar 103. The blade tang channel 103 is illustrated as traversing the blade tang 101; however, other configurations such as an inset channel guide could accomplish the purpose of guiding the lock bar pin 222 from an open to a closed position and vice versa. In the preferred embodiment, the lock bar channel 103 has grooves on either side of the channel, one groove is a open lock tang groove 104 and the other is a closed lock tang groove 105. In some instances, more than two grooves may be useful. Depending on the respective form and shape of the liner, lever, and other components, the shape of the blade tang may be varied. In the preferred embodiment, two indents are provided between the blade and the tang. One indent provides the closed blade-to-stop interface 106 which abuts the closed blade stop post 919. The other indent, also called the open blade-to-stop interface 107 abuts the open blade stop post 915. The respective stop posts interfere with any further rotation of the blade when it is engaged in an opening or closing motion. The tang 101 of the preferred embodiment also is shaped with lever interfaces on either side of the tang 101 base. The open tang-lever interface 109 comes into contact with the lever 30 when the blade 10 is open. The closed tang-lever interface 108 comes into contact with the lever 30 when the blade 10 is closed. The tang and lever interfaces are used to remove play and wobble from the blade while in use.

Figure 21:
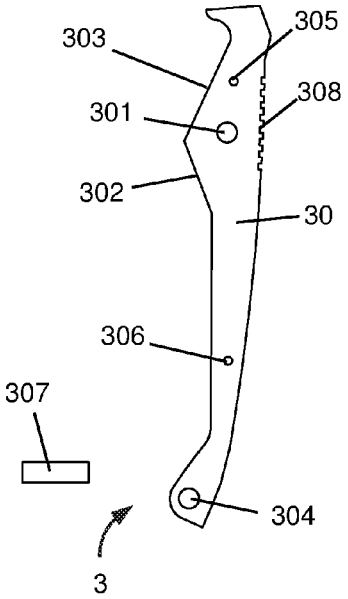
FIG. 21 is a plan view of a lever with the corresponding handle-to-lever pivot shown in isolation.

FIGS. 20-21 schematically demonstrate the link assembly 2 and lever assembly 3. In both FIGS. 20-21, the components are laid open. In FIG. 20, two link arms 20, 21 are shaped to provide the axis points 201, 211 for the fixed point, lever-to-link pivot bar 221. The other end of the link arms 20, 21 provide attachment points 202, 212 for the lock bar 222. For the preferred embodiment, the lock bar 222 is affixed to only one of these attachment points. In the embodiment demonstrated, the lock arm 222 is affixed at attachment point 212 by means such as press fitting, tack welding, bolting or screwing. The attachment point 212 for the lock bar 222 is evident in FIG. 12. The lock bar 222 is held at 202 by the same interference fit as the other pivots of the assembly. The side view of the lever arm 30 in FIG. 21 demonstrates the lever-to-link pivot axis 301 where the lever-to-link pivot bar 221 shown in FIG. 20 would be inserted. The blade interface, or cleat 302, 303 abuts the tang at either the open lever interface 109 or the closed lever interface 108 depending on the position of the blade. The handle-to-lever pivot axis 304 receives the handle-to-lever pivot bar 307 which is shown in plan view alongside the lever arm 30 in FIG. 21. Assembly holes 305, 306 are illustrated as examples of locations where hardware may be employed to fasten the various parts of the knife together. Finally, a machined texture 308 is provided for grip and leverage when the knife 1 is in use and will be particularly useful when the knife is open.

Figure 22:
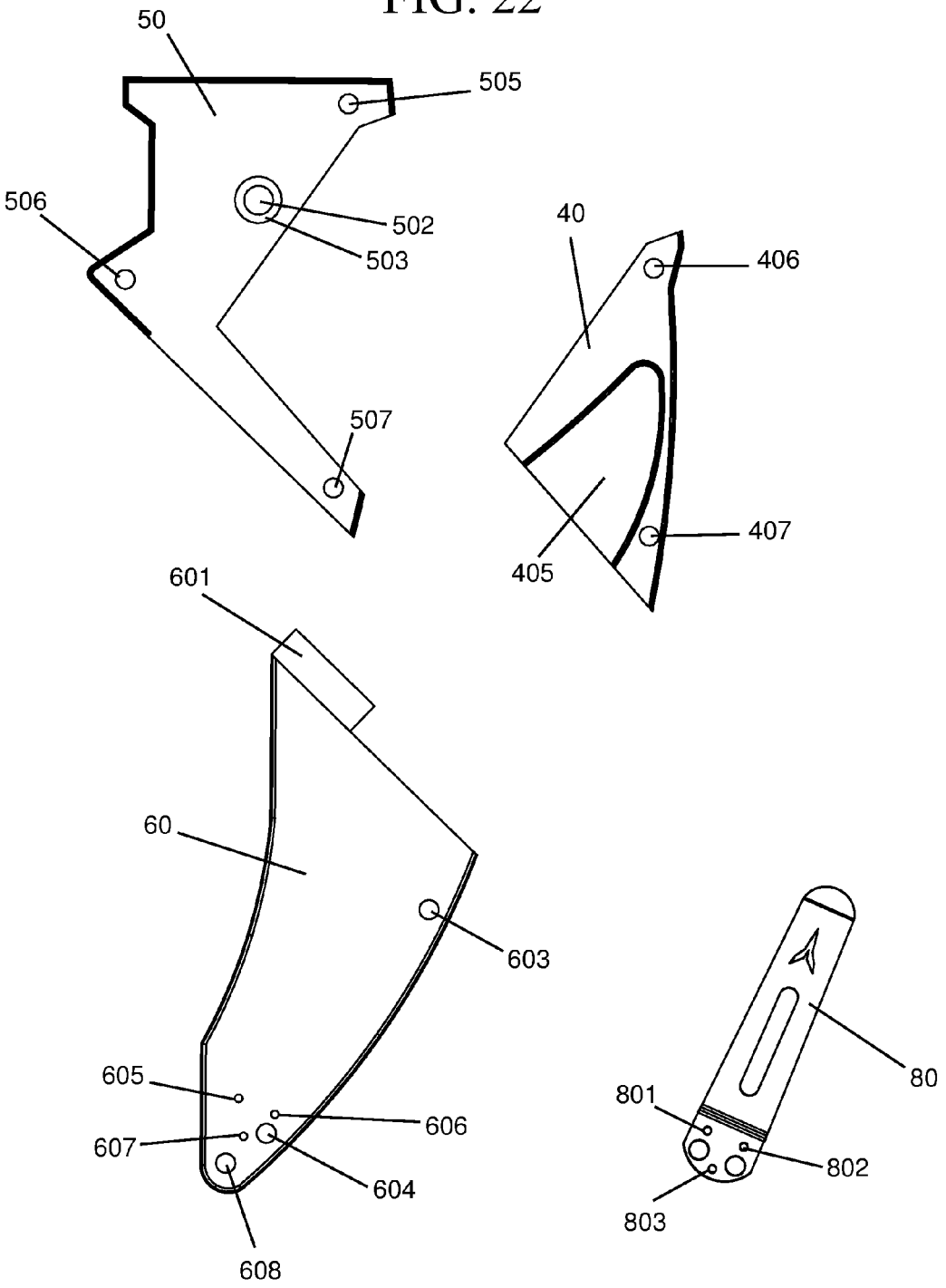
FIG. 22 is an exploded, first side view of the outer casing which is made of a bolster, a grip, a handle and a pocket clip shown in isolation.
Figure 23:
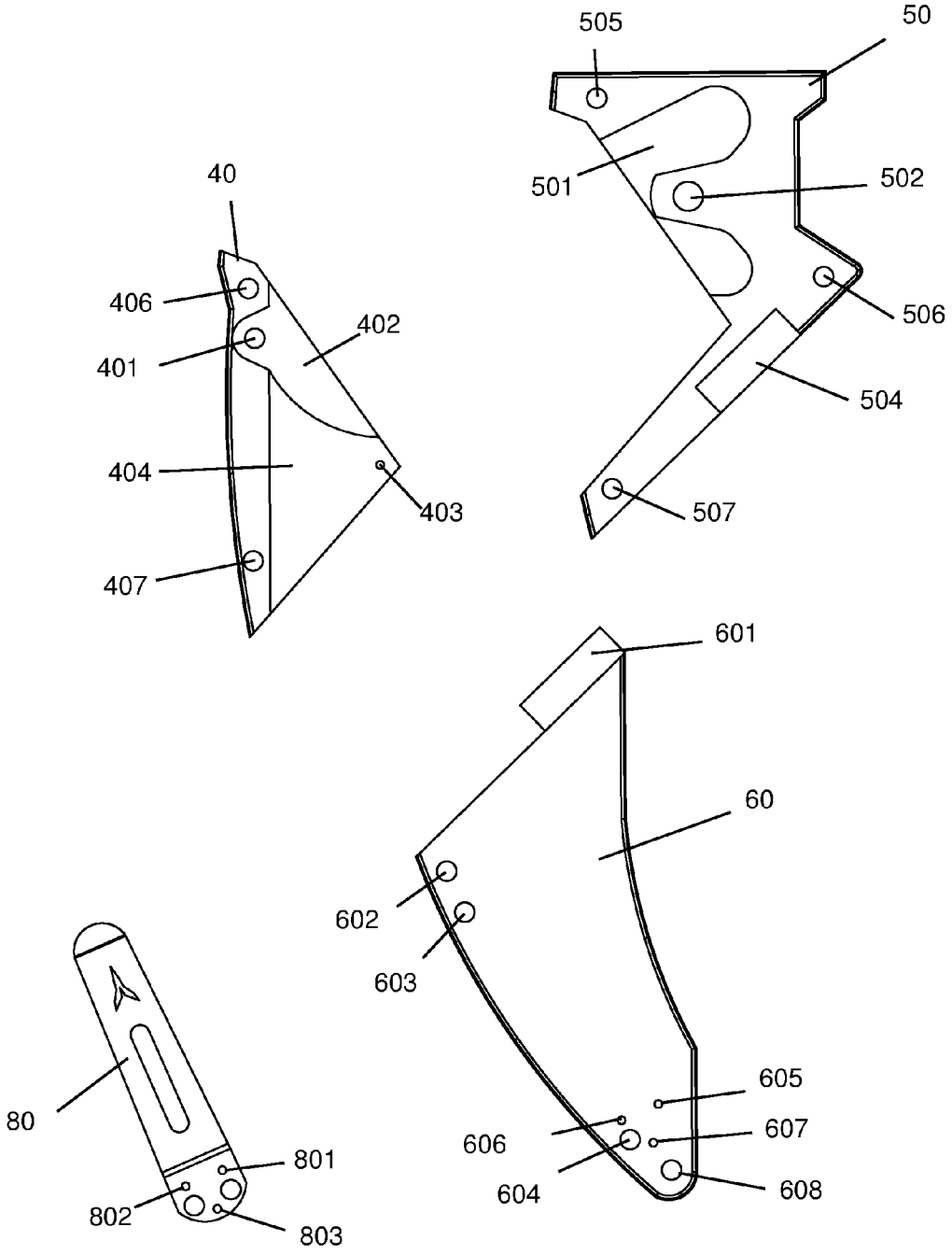
FIG. 23 is an interior plan view of the outer casing as demonstrated in FIG. 22.
Figure 24:
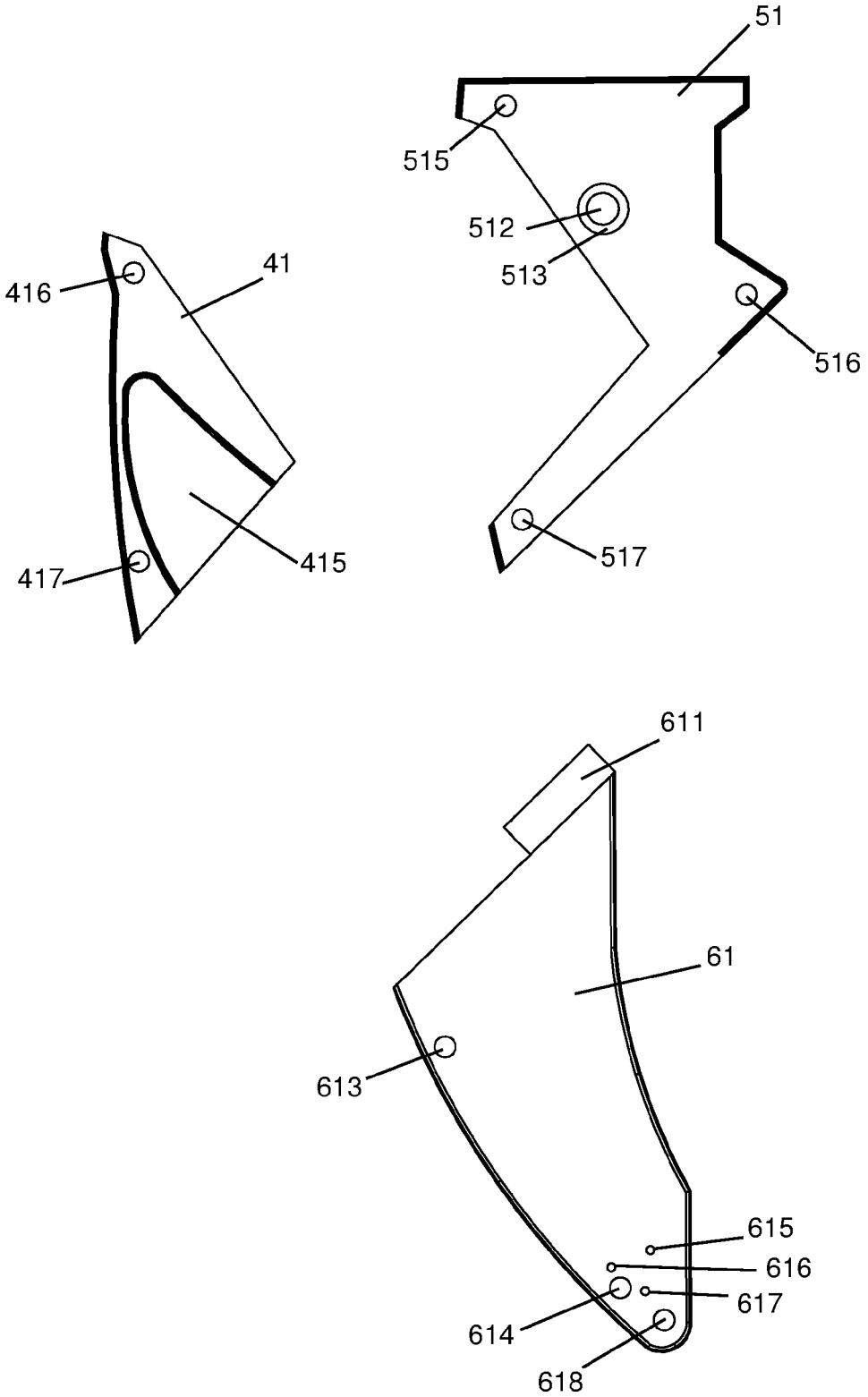
FIG. 24 is an exploded, second side view of the outer casing showing each of a bolster, a grip, and handle in isolation.
Figure 25:
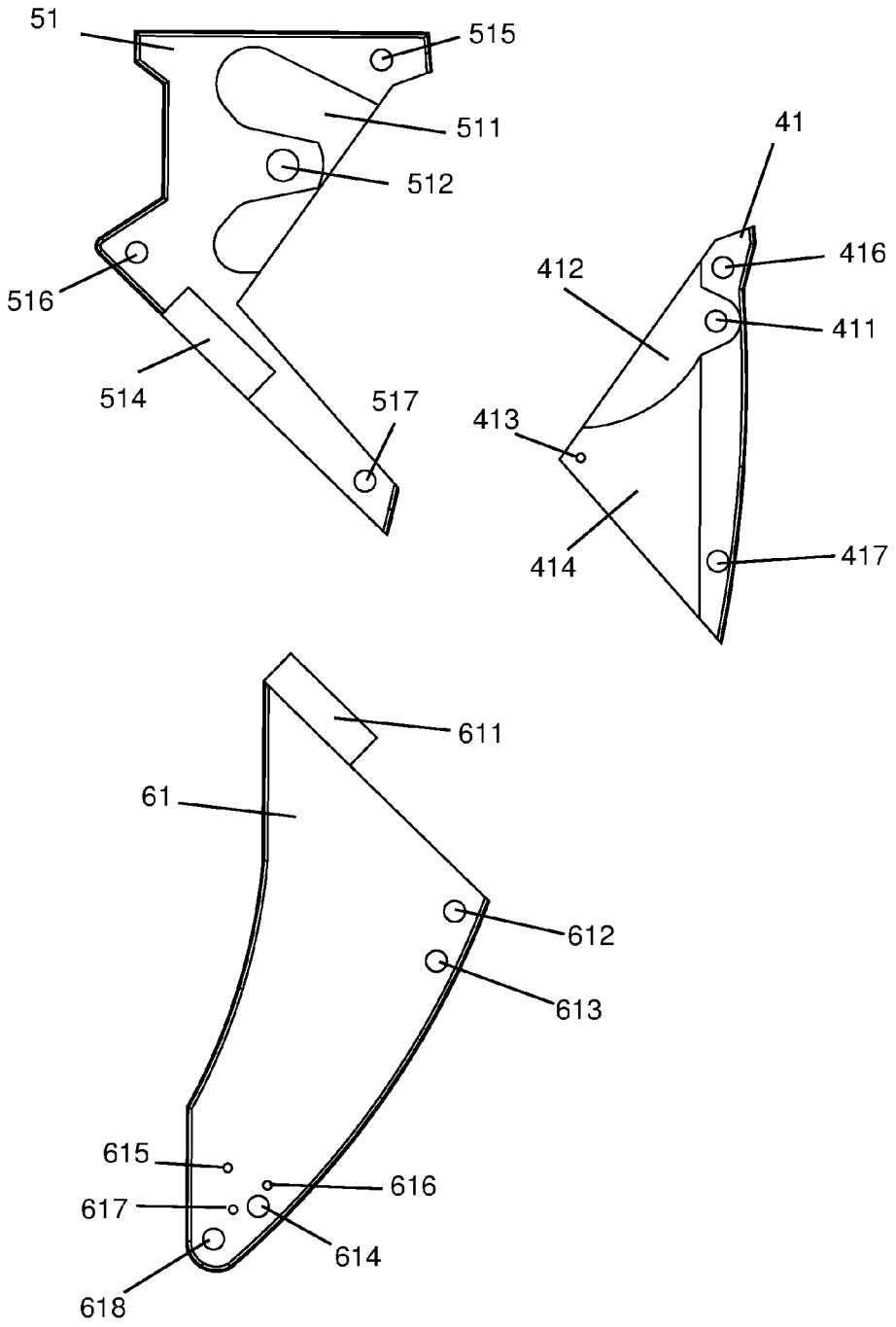
FIG. 25 is an interior plan view of the outer casing as demonstrated in FIG. 24.

The major features of the exterior of one bolster 50, lever grip 40, handle 60, and pocket clip 80 are laid open and illustrated in FIG. 22. Meanwhile, the interior of the same components are shown in FIG. 23. In the preferred embodiment, the bolster, the lever grip, and the handle occur in pairs on either side of the blade 10, liners 70, 72, and link assembly 2 and lever assembly 3. Therefore, FIGS. 24-25 illustrate the exterior and interior views of the second half of the bolster 51, lever grip 41, and handle 61 of the preferred embodiment. The pocket clip, if used, may be used on only one side of the knife, but it may be omitted or used on two sides as well.

The lever grip 40, 41 is illustrated in the respective versions of FIGS. 22-25. Each lever grip 40, 41 is equipped with the lever-to-link pivot recess 401, 411, an interior clearance cut out for lock bar movement 402, 412, a ball catch recess 403, 413, a cut out for liner clearance 404, 414, an exterior finger groove 405, 415 and various assembly holes 406, 416, 407, 417.

The bolsters 50, 51 are also illustrated near the top of each of FIGS. 22-25. Similar to the lever grip, the bolster 50, 51 also has a link lock bar movement clearance cut out 501, 511 to allow sufficient space for the articulation of the link arms, pivots, and lock bar of the link assembly 2. The bolsters 50, 51 of the preferred embodiment also have a blade pivot hole 502, 512 to receive the main blade pivot bolt 912 and a pivot head recess 503, 513 to receive the blade pivot head 913. In the preferred embodiment, a first bolster 50 is the mirror image of a second bolster 51. In this embodiment, these two bolsters 50, 51 are separate pieces with respective receiving recesses 504, 514 into which the handle inserts 601, 611 fit when the handle assembly 5 is constructed. See FIGS. 8-9 and 22-25. In certain embodiments, it may be advantageous to make the bolster 50, 51, and the handle 60, 61 one single unit. Again, the bolsters 50, 51 are provided with various assembly holes 505, 515, 506, 516, 507, 517.

With continuing reference to FIGS. 22-25, the interior and exterior walls of the handle 60, 61 are illustrated. In the preferred embodiment, the handle 60, 61, is shaped with a handle insert 601, 611 to lay within the bolster recesses 504, 514. The handle-to-lever pivot bar 307 will be received into the lever/handle pivot recess 602, 612. Various assembly holes 603, 604, 613, 614 are provided in the handle. When a pocket clip 80 is used, it will attach to one or more of the handles 60, 61 via the pocket clip attachment holes 605, 615, 606, 616, 607, 617. The pocket clip 80 will have corresponding attachment holes 801, 802, 803. When a lanyard hole 608, 618 is needed, it is desirable for it to occur in the base area of the handle 60, 61.

Figure 26:
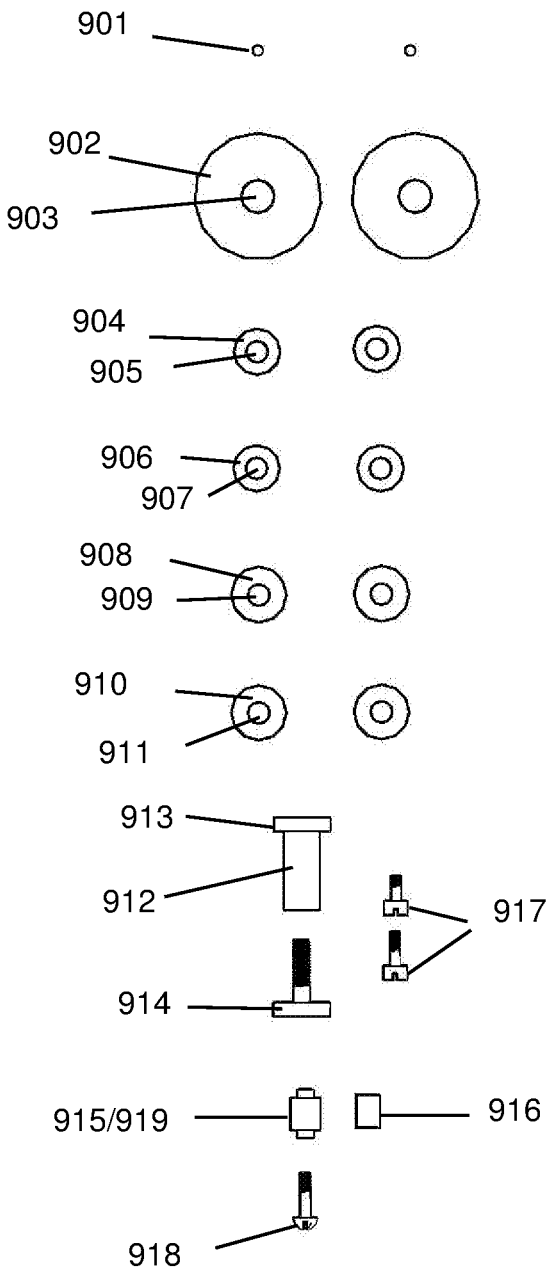
FIG. 26 is an elevation view of sample hardware pieces used to assemble the present invention.
Figure 27:
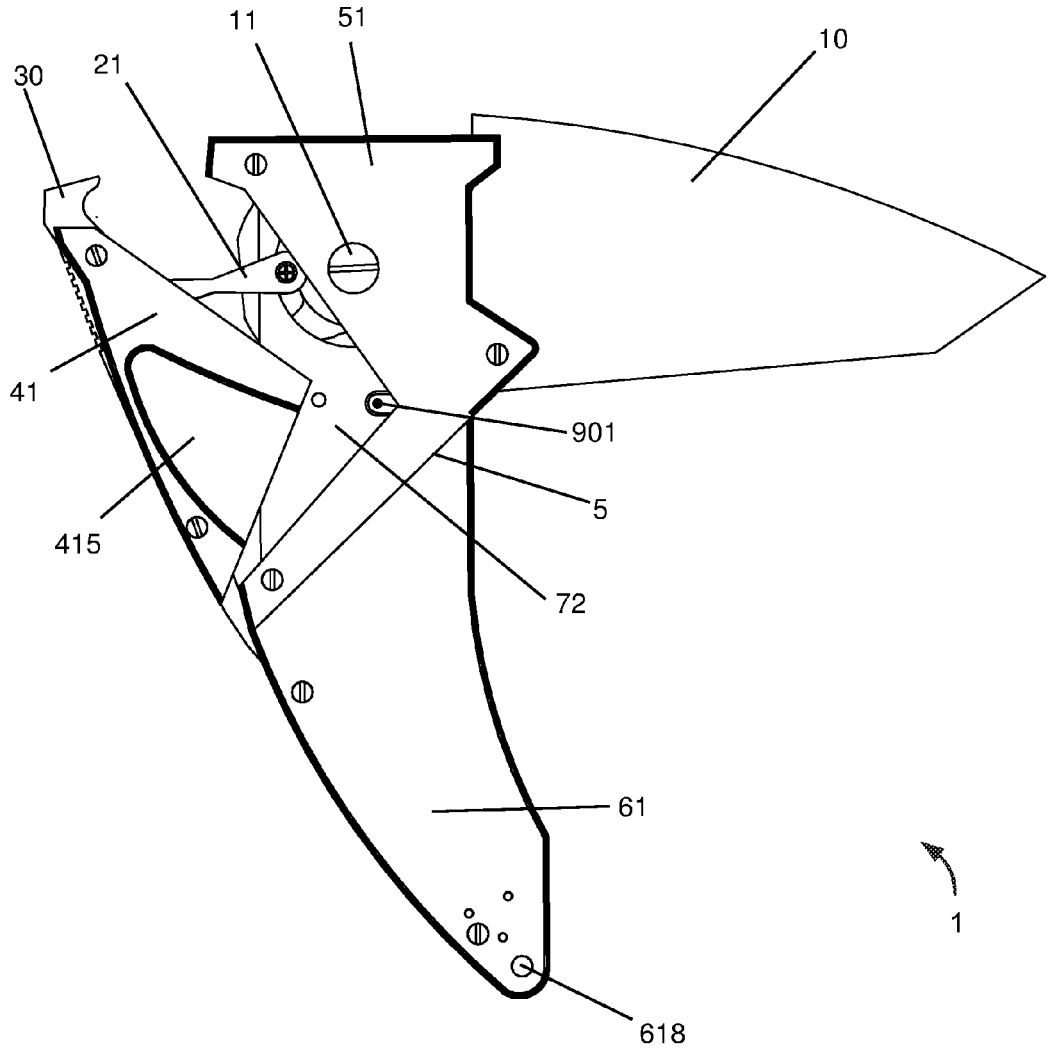
FIG. 27 is the second side plan view of the present invention showing the blade action during opening or closing.

By way of example and not by way of limitation, example hardware is illustrated in FIG. 26. Among the hardware, or the equivalents thereof, that may be used are the following: ball 901, blade washer 902, blade pivot hole 903, interior link/lever alignment spacer 904, link-to-lever pivot hole 905, exterior link/lever alignment spacer 906, link/lever pivot hole 907, lock bar washer 908, lock bar washer hole 909, handle/lever washer 910, handle/lever pivot hole 911, blade pivot 912, blade pivot head 913, pivot screw 914, blade open stop post 915, threaded standoff spacer 916, assembly screw 917, pocket clip assembly screw 918, and blade closed stop post 919. See discussion of these sample components relative to the preceding drawing descriptions.

The blade, handle, and structural components may be fabricated from any desired materials. Preferably, the blade will be constructed of steel, such as carbon steel, stainless steel, tool steel, or alloy steel. However, other materials like cobalt, titanium alloys, ceramics, obsidian, or even plastic may be used so long as the material will form a reliable cutting surface. The handle assembly may be constructed of many various materials also ranging from plastic to steel to rare or precious materials. The interior components of the present invention will be desirably constructed of materials which resist wear, rust, or other degradation.

Depending on the intended design and tool the best angle required for use may not be at 180 degrees from the handle. Slight modifications of the mechanism will permit the blade to be opened or closed to a variety of angles depending on the positioning of the mechanism during the initial design and thus allows application of the mechanism to other folding hand tools, such as a small pick axe. In the preferred embodiment, the open and closed position of the blade does not require the blade to travel a full 180 degrees yet locks the blade in a substantially straight position for use. In cases such as these, the mechanism can be adjusted so that when deployed the tool is at the optimal angle (for example, a knife at 180 degrees or a pick axe at 90 degrees). In any application, the mechanism allows knife operation by those with handicaps or dexterity issues.

In one embodiment of the present invention, the blade does not travel 180 degrees to close within the handle. The round back of handle makes it shorter and otherwise more ergonomic for use. Because the blade does not travel a full 180 degrees it has less distance to travel and can arrive at a position for use more quickly. The knife will have a faster reaction to the user's initial action to open or close the blade.

It is further intended that any other embodiments of the present invention which result from any changes in application or method of use or operation, method of manufacture, shape, size, or material which are not specified within the detailed written description or illustrations contained herein are yet considered apparent or obvious to one skilled in the art are within the scope of the present invention.

What is claimed is:

1. A folding knife mechanism for ambidextrous use comprising:

a blade comprised of a cutting edge and a blade tang,
  the blade tang having a first channel with at least one first channel lock groove,
  the blade tang further having at least one blade tang indent, a handle having a sheath sized to receive the blade, the handle further comprising a second channel with at least one second channel lock groove,
  a main pivot about which the blade articulates relative to the handle between a first position and a second position which correspond with an open blade position and a closed blade position,
    the handle further comprising at least one stop post to engage the blade tang indent, a lever having a lever grip and joining with the handle via a handle-to-lever pivot,
  the lever further comprising an interface to abut the blade tang in the open blade position and the closed blade position, a lever-to-link pivot joining the lever and a link,
  the link being affixed to one end of a lock bar, the lock bar being formed to travel in the first channel and the second channel until the lock bar locks into the at least one first channel lock groove and the at least one second channel lock groove, one of the at least one first channel lock groove corresponding to the open position, one of the at least one second channel lock groove corresponding to the open position, wherein the blade is actuated from the first position to the second position by a repetition of a single action where the lever is pivoted away from the handle at the handle-to-lever pivot when the lever grip is grasped by a thumb and finger of either hand and the blade is oriented away from a user's palm.

2. The folding knife mechanism of claim 1, wherein the at least one first channel lock groove comprises two grooves at either end of the first channel.

3. The folding knife mechanism of claim 2, wherein the two grooves of the first channel further comprise a first groove corresponding to the open blade position and a second groove corresponding to the closed blade position.

4. The folding knife mechanism of claim 1, wherein the at least one second channel lock groove comprises two grooves at either end of the second channel.

5. The folding knife mechanism of claim 4, wherein the two grooves of the second channel further comprise a first groove corresponding to the open position and a second groove corresponding to the closed blade position.

6. The folding knife mechanism of claim 1, wherein the link is shaped as a figure-8 with the lock bar affixed to one end of the figure-8.

7. The folding knife mechanism of claim 1, further comprising at least one ball catch and at least one ball catch recess to further secure the blade in the closed position until the single action releases the catch from the recess.

8. The folding knife mechanism of claim 7, wherein the at least one first channel lock groove comprises two grooves at either end of the first channel, wherein the at least one second channel lock groove comprises two grooves at either end of the second channel, wherein the single action activates a series of movements within the knife, the series of movements further comprising:

pivot of the lever away from the handle, release of the ball catch from the ball catch recess, disengagement of the lock bar from the at least one first channel lock groove and the at least one second channel lock groove, rotation of the blade tang, simultaneous travel of the lock bar in the first channel in the blade tang and also in the second channel in the handle, articulation of the blade from the open position toward the closed position or from the closed position toward the open position, oscillation of the lock bar between the two grooves of the at least one first channel lock groove and the two grooves of the at least one second channel lock groove, pivot of the lever back toward the handle ending the travel of the lock bar in the first channel and the second channel, thereby locking the lock bar in a first of the two grooves of the second channel lock groove of the handle, locking the lock bar in a first of the two grooves of the first channel lock groove of the blade tang, re-engaging the blade tang and the interface of the lever, resetting the catch in the recess.

9. A mechanism to fold and unfold a knife about a main pivot upon the introduction of momentum from a single-handed action of a user comprising:

a blade having a blade tang, a handle assembly having two handles and two bolsters, two liners to frame the handle assembly and the blade of the knife, a lever pivotally attached to the handle assembly and the lever having two lever grips, a catch interposed between the lever grips and the liners to engage a catch recess within the lever grips, a link arm linking the lever to an oscillating pin by a pivot, the oscillating pin disposed to travel within two liner guide channels and a blade tang guide channel upon the introduction of the single-handed action of the user, each liner guide channel terminates with two liner guide lock grooves, the blade tang guide channel terminates with two blade tang lock grooves, the oscillating pin disposed to lock into two of the four liner guide lock grooves and into one of the two blade tang lock grooves when the blade is folded and unfolded, wherein the single-handed action of the user pivots the lever away from the handle which in turn pivots the pivot of the link arm thereby disengaging the oscillating pin from the blade tang lock grooves and liner guide lock grooves, once disengaged the oscillating pin follows the momentum of the single action to travel within the two liner guide channels and the blade tang guide channel until the oscillating pin is stopped and locked into two of the four liner guide lock grooves and into one of the two blade tang lock grooves after which the blade is again folded or unfolded, the blade tang and the lever interface when the blade is folded or unfolded to give structural support between the lever and the blade tang, the liners further framing the main pivot, the liner guide channels, the liner guide lock grooves, and the catch recess.

* * * * *